US008091463B1

(12) United States Patent
Moody

(10) Patent No.: US 8,091,463 B1
(45) Date of Patent: Jan. 10, 2012

(54) MACHINE GUN AMMUNITION HOLDER INCORPORATING CENTER OF GRAVITY DOWNWARD EJECTION-DEFLECTOR

(76) Inventor: Joseph R. Moody, Jacksonville, FL (US)

( * ) Notice: Subject to any disclaimer, the term of this patent is extended or adjusted under 35 U.S.C. 154(b) by 415 days.

(21) Appl. No.: 12/362,695

(22) Filed: Jan. 30, 2009

Related U.S. Application Data

(63) Continuation-in-part of application No. 11/745,643, filed on May 8, 2007, now Pat. No. 7,798,047.

(51) Int. Cl.
*F41A 9/34* (2006.01)

(52) U.S. Cl. ..... 89/33.1; 89/34

(58) Field of Classification Search ..... 89/33.1, 89/33.02, 34
See application file for complete search history.

(56) References Cited

U.S. PATENT DOCUMENTS

| | | | | | |
|---|---|---|---|---|---|
| 2,180,741 | A | * | 11/1939 | John Lisov | 89/33.16 |
| 3,293,986 | A | | 12/1966 | Stoner | |
| 4,389,918 | A | | 6/1983 | Peck | |
| 4,468,875 | A | * | 9/1984 | Harrison et al. | 42/50 |
| 4,715,141 | A | | 12/1987 | Kohnke | |
| 4,753,155 | A | | 6/1988 | Balister | |
| 4,939,979 | A | | 7/1990 | Capawana | |
| 6,675,693 | B1 | | 1/2004 | Heayn | |
| 6,799,500 | B1 | | 10/2004 | Kulikowski | |
| 2008/0092728 | A1 | | 4/2008 | Stussak et al. | |
| 2008/0140514 | A1 | | 6/2008 | Stenger | |

* cited by examiner

*Primary Examiner* — Stephen M Johnson
(74) *Attorney, Agent, or Firm* — Brian S. Steinberger; Law Offices of Brian S. Steinberger, P.A.

(57) ABSTRACT

Devices, apparatus, systems and methods of mounting ammunition holders for side loading machine guns and weapons that downwardly eject spent cartridges. The ammunition holders include adjustable hinges attached side plates that both moves the center of gravity of the left side supported ammunition holder to move in a right direction underneath the machine gun until the ammunition holder is balanced relative to the machine gun. The side plate further deflects the spent cartridges from being directly ejected downward from the machine gun and instead deflect the spent cartridges to one side of the machine gun away from both the machine gun and an operator of the gun. The ammunition containers can be ammunition belt boxes. The ammunition containers can be ammunition pouch bags. Frames can allow for bags to be inserted therein and be pre-shaped to form a deflection surface by a built on side wall which functions as a deflection plate to deflect spent cartridges and shells sideways away from the gun.

21 Claims, 25 Drawing Sheets

MACHINE GUN AMMUNITION HOLDER INCORPORATING CENTER OF GRAVITY DOWNWARD EJECTION-DEFLECTOR

This invention is a Continuation-In-Part of U.S. patent application Ser. No. 11/745,643 filed May 8, 2007, now U.S. Pat. No. 7,798,047.

FIELD OF INVENTION

This invention relates to guns with ammunition bags, such as machine guns, and in particular to devices, apparatus, systems and methods of mounting and using machine gun ammunition type holders, namely ammunition belt boxes and pouch bags, where the center of gravity of the mass and the weight of side mounted ammunition holders is pulled and moved to an overall balanced position relative to the machine gun, and/or the holders incorporates adjustable hinge attached deflectors for deflecting downwardly ejecting spent cartridge cases from the gun, and/or the use of kits for mounting the boxes and bags therein.

BACKGROUND AND PRIOR ART

Various popular machine guns such as the FN (Fabrique Nationale) Mag, the 240/Mag, the German MG3 and MG42/59 machine gun manufactured by Rhinemettall and other licensed and unlicensed copies of these machine guns use either a side hanging drum type box or pouch-bag to store and feed ammunition to the machine gun. Such ammunition boxes and bags are needed to hold and bundle linked rounds. However, there are many problems with such side hanging ammunition boxes and bags. These boxes and bags vary in size to hold 50 to 150 linked rounds. The most popular being the 100 round box or bag that weighs approximately 5 pounds.

Spent cartridges are exhausted generally downward from these popular types of machine guns and can hit the soldier/operator. Also, if the machine gun is mounted on a stand above a ground surface, the spent cartridges can bounce down and reflect up hitting the soldier/operator as well.

Pouch bags made from fabric material can easily become damaged and ruined by the downwardly ejected spent cartridges. For example, spent cartridges that bounce against a ground surface can also bounce up striking the fabric surfaces of the pouch bag and both damage and further ruin the pouch bag.

Furthermore, the weight and mass of the side hanging ammunition box and bag causes other problems since the current boxes and bags solely hang to one side of the firearm, which pulls the firearm off-balance and to one side. The current hanging boxes and bags create a side pulling weight that tends to cause the soldier/operator to overcompensate the weight to one side of the firearm in order to orient the firearm into a firing position. This constant repositioning can affect the aim and resulting shots from the machine gun.

Additionally, the weight and mass of the side hanging bags and boxes also makes the firearms difficult to carry and move into place. Additional seconds of extra time to carry and position the firearm can affect the necessity for using the firearm that exist in immediate use applications such as in combat type situations.

Trying to solve these problems by positioning extra bags and/or weights on the opposite side so that the firearm has two bags (or counter-weight) each hanging to one side to balance the firearm does not overcome these problems. The popular machine guns require a feed type belt to the left side of the gun that can only be inserted into one side bag. Thus, in a short time, one bag type side weight would easily outweigh the other side and still cause the side tilting and offset balance problem. Additionally, adding another load does not stop the spent cartridge cases from still ejecting downward and causing the other previously listed problems. Still furthermore, using extra bags and/or opposite side weights would make the carrying and positioning the machine gun impractical and tedious to use. The extra mass and weight of using additional bags (or counter-weight(s)) would add unnecessarily carrying loads to the operator/soldier who already is required to carry a substantial amount of gear.

Thus, the need exists for solutions to the above problems with the prior art.

SUMMARY OF THE INVENTION

This invention pertains to only downward ejecting weapons, such as but not limited to belt fed machine guns which eject empty shells down through the central receiver which makes it virtually impossible to utilize a center of gravity belt box or bag. Many belt fed machine guns utilize side ejecting models which eject empty shells to the side of the machine gun which allows these guns to incorporate a center of gravity ammunition belt or box directly under the weapon to enhance balance with proper center of gravity. These side ejection machine guns are not pertinent to this invention as they need no empty round deflector.

This novel ammunition holder and deflector have plural benefits. The ammunition holder deflects the downwardly ejected spent shells from the machine gun to one side such as the right side, and allows an ammunition box and bag to be generally positioned under the weapon for a proper center of gravity location. Additionally, the ammunition holder and deflector is used to pull the ammunition box or bag to a right angle in order to position the major mass of ammunition in the box or bag to the right to balance the left hanging ammunition box or bag which these weapons use.

A primary objective of the present invention is to provide devices, apparatus, systems and methods of mounting and using machine gun ammunition holders, namely ammunition belt boxes and pouch bags, where the center of gravity of the ammunition holders is moved to an overall balanced position relative to the gun, and the holders incorporate deflectors for deflecting downwardly ejecting spent cartridges from the machine gun to one side of the gun.

A secondary objective of the present invention is to provide devices, apparatus, systems and methods of mounting and using machine gun ammunition holders, namely ammunition belt boxes and pouch bags, where existing ammunition holders can be retrofitted so that a bottom edge portion of the holders are moved from a left side of the gun underneath the gun to the right until the overall mass of the bag balances the gun, and the holder incorporate deflectors for deflecting downwardly ejecting spent cartridge cases to the right side from the machine guns.

A third objective of the present invention is to provide devices, apparatus, systems and methods of mounting and using machine gun ammunition holders, namely ammunition belt boxes and pouch bags, that prevent downwardly ejecting spent cartridge cases from hitting the operator/soldier.

A fourth objective of the present invention is to provide devices, apparatus, systems and methods of mounting and using machine gun ammunition holders, namely ammunition belt boxes and pouch bags, where the center of gravity of the mass of the holders is pulled and moved to an overall balanced position relative to the gun while portions of the holders deflect downwardly ejecting spent cartridge cases to the side of the gun, without adding substantial weight, mass or gear to the machine gun.

A fifth objective of the present invention is to provide devices, apparatus, systems and methods of mounting and using machine gun ammunition holders, which have adjustable hinges to move deflection plates to different angles by locking the position of the deflectors with switches, such as but not limited to push buttons, and the like.

A sixth of the present invention is to provide devices, apparatus, systems and methods of mounting and using machine gun ammunition holders that can have rigid shapes that include frames and/or complete holders, where the shapes allows for deflection of ejected ammunition shells and cartridges to the side of the weapon.

In a preferred embodiment, a side belt loading machine gun that downwardly dispenses spent cartridges from an ejector under the gun uses a novel hinge attached deflector with a ammunition holder that deflects the downwardly directed spent cartridges to one side of the gun, and has a substantial portion of the bag moved from a left side of the gun underneath the gun to the right until the overall mass of the bag balances the weapon.

An ammunition holder for machine guns that downwardly eject spent cartridge cases, can include an ammunition container for holding plural linked rounds of belted ammunition, wherein the container has an overall weight and mass, a mount mechanism for attaching the container to a side belt feeder on one side of the machine gun, the container having an outer side facing away from the machine gun and an inner side facing underneath the machine gun, and an adjustable hinge attached plate fastened to the inner side of the ammunition container. The plate moves the center of gravity of mass and weight of the plural linked rounds of the belted ammunition held in the ammunition container from the one side of the machine gun underneath the gun in the direction of an opposite side of the machine gun until the center of gravity of the mass and weight of the container balances the machine gun, and wherein the plate deflects the downwardly ejected spent cartridges from the machine gun to a side of the machine gun away from both the machine gun and the operator of the machine gun.

The ammunition container can include a pouch bag having a fabric surface.

The ammunition container can include a polymer and/or plastic ammunition box.

The ammunition container can include a metal ammunition box.

The plate can be formed from a group selected from one of a polymer, a plastic and a fiberglass, and combinations thereof, and the like.

The plate can be formed from a group selected from one of steel, galvanized metal and aluminum, and the like, and combinations thereof.

The plate can be an angled plate.

The plate can be a planar-plate with a bent portion.

The plate can include a concave curved surface.

The plate can be a right triangular plate.

The invention can include a novel method of mounting ammunition holders to machine guns having downwardly ejecting spent cartridge cases, comprising the steps of providing a machine gun with a belt ammunition feeder on one side of the machine gun, and a bottom ejector that downwardly ejects spent cartridge cases, the machine gun having a center of gravity, attaching an ammunition holder that holds a bundle of linked rounds to the side belt feeder on the machine gun, the ammunition holder with the bundle of linked rounds having a mass and weight with a center of gravity, and moving the center of gravity of the mass and the weight of the ammunition holder to an overall balanced position relative to the gun by hinge attached plates.

The method can further include the steps of deflecting the spent cartridge cases from being ejected directly downward by a surface portion of the ammunition holder to one side of the machine gun away from both the machine gun and an operator of the machine gun.

The deflecting step can includes the step of providing an angled plate on an inner side of the ammunition holder.

The method can further include the steps of providing a kit having the angled plate and fasteners for attaching the plate to the ammunition holder, and performing the attaching and deflecting steps to a pre-existing machine gun and ammunition holder.

The moving step and the deflecting step can both includes the step of providing an angled plate on an inner side of the ammunition holder that dually both adjusts the center of gravity of the ammunition holder and deflects the downwardly ejecting spent cartridges to the side of the machine gun.

The moving step and the deflecting step can includes the step of pulling and moving the center of gravity of the mass and the weight of the ammunition holders from the one side of the weapon underneath the weapon toward an opposite side direction to a balanced position relative to the machine gun.

The invention can be included with an improved automatic machine gun that includes a machine gun having a side belt ammunition loader on a left side, with a bottom ejector for downwardly ejecting spent cartridge cases beneath the machine gun, an ammunition container for holding plural rounds of belt linked ammunition, with a mount mechanism for attaching the container to the side belt feeder on the left side of the machine gun, the container having an outer side facing away from the machine gun and an inner side facing underneath the machine gun, the container with the belt linked ammunition having a mass and a weight with a center of gravity, and a plate attached to the inner side of the ammunition container for bending the container so that the center of gravity of the mass and weight of the ammunition container is moved from the left side to a right side underneath the machine gun in order to balance the mass and the weight of the ammunition container relative to the machine and, and wherein the plate deflects spent cartridges ejected downwardly from the machine gun to one side of the machine gun away from both the machine gun and an operator.

The ammunition container can be a pouch bag having a fabric surface.

The ammunition container can be a plastic and/or polymer ammunition box.

The ammunition container includes a metal ammunition box.

Further objects and advantages of this invention will be apparent from the following detailed description of the presently preferred embodiments which are illustrated schematically in the accompanying drawings.

BRIEF DESCRIPTION OF THE FIGURES

FIG. 12 shows the ammunition holder of FIG. 11 with push button pressed in.

DESCRIPTION OF THE PREFERRED EMBODIMENTS

Figure 2:
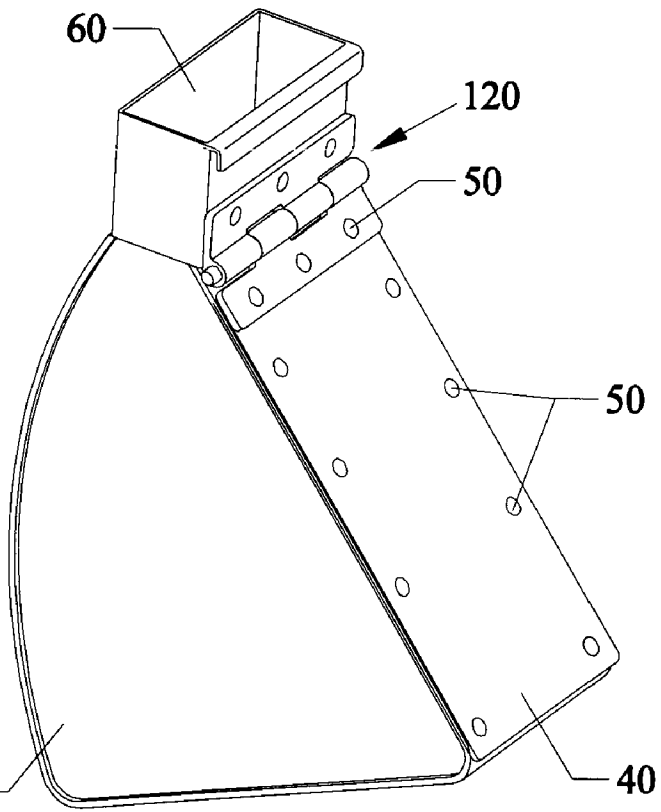
FIG. 2 is a front perspective view of the ammunition holder of FIG. 1 with a straight deflector plate locked up at an angle, for example, 40 degrees.

Before explaining the disclosed embodiments of the present invention in detail it is to be understood that the invention is not limited in its applications to the details of the particular arrangements shown since the invention is capable of other embodiments. Also, the terminology used herein is for the purpose of description and not of limitation.

This invention is a Continuation-In-Part of U.S. patent application Ser. No. 11/745,643 filed May 8, 2007, which is incorporated by reference. The parent application describes the use of bent and angled deflector side plates for the ammunition bag that allow for moving the center of gravity of the mass and the weight of the ammunition holder to an overall balanced position relative to the gun, and for deflecting the spent cartridge cases from being ejected directly downward by a surface portion of the ammunition holder to one side of the machine gun away from both the machine gun and an operator of the machine gun.

A listing of the components will now be described.

10. Ammo bag assembly with adjustable C.G. (straight deflector plate) with plate locked down.
20. Same as 10 with plate locked up.
30. Canvas Ammo bag assembly (prior art).
40. Straight deflector plate.
50. Rivet or other fastener.
60. Steel box mounting bracket (prior art).
70. Ammo bag assembly with adjustable C.G. (curved deflector plate) with plate locked down.
80. Same as 70 with plate locked up.
90. FN240 machine gun (prior art).
100. Chain feed ammo.
110. Spent shells.
120. Adjustable locking hinge assembly.
130. Curved deflector plate.
140. Button to unlock hinge and allow it to pivot.
150. Hinge leaf #1.
160. Hinge leaf #2.
170. Locking hinge pin.
180. Polygon shaped locking element (part of 170). Change the number of sides to reconfigure the design for different adjustable angle increments. 360 degrees/# of sides=angle increment. Example: 360 degrees/9 sides=40 degrees of pivot between stops.
190. Polygon shaped press-in plug presses into hinge knuckle to retain hinge pin.
200. Locking hinge pin return spring.
210. Hinge knuckle with only hinge pin hole.
220. Hinge knuckle with only polygon shaped thru hole.
230. Polygon shaped thru hole.
240. Round hole for hinge pin.
250. Hinge knuckle with polygon shaped counter-bore and round hinge thru hole.
260. Polygon shaped counter-bore in knuckle.
270. Round hole for hinge pin.
280. Hinge knuckle with only round thru-hole for hinge pin.
290. Threaded end of locking hinge pin threads into lock button (#140).
300. Hard sided (molded plastic or sheet metal) ammo box assembly with C.G. shifted under the gun.
310. Canvas ammo bag assembly (prior art).
320. Fastener conversion kit (rivets or screws).
330. Adhesive/Glue-on conversion kit.
340. Adhesive/Glue.
350. Slip-over conversion kit using glue or fasteners to secure kit to bracket.
360. Soft or hard slip-over container.
370. Slip-over kit conversion kit using strap to secure kit to bracket.
380. Strap securing conversion kit to bracket.
390. Clamp-on conversion frame with straight deflector plate.
400. Conversion frame clamp.
410. Clamp screw.
420. Clamp washer.
430. Clamp nut.
440. Conversion frame straight deflector plate.
450. Conversion frame bag repositioning flange.
460. Ammo Bag containment gusset.
470. Ammo Bag containment flange.
480. Clamp-on conversion frame with adjustable locking hinge.
490. Clamp-on conversion frame with curved deflector plate.
500. Conversion frame curved deflector plate.

Figure 1:
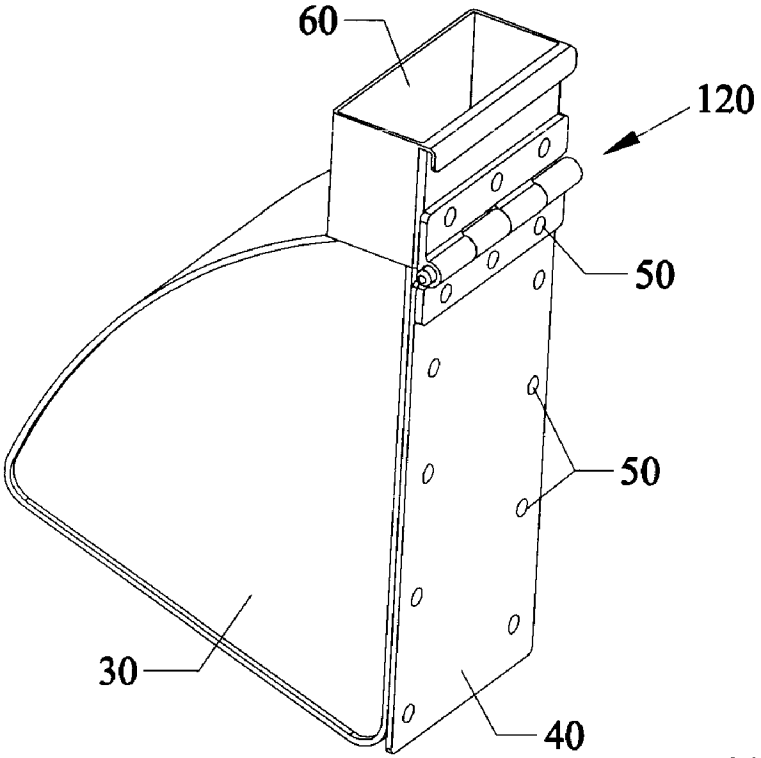
FIG. 1 is a front perspective view of the ammunition holder with a straight deflector plate locked down.

FIG. 1 is a front perspective view of the ammunition bag assembly 10 with a straight deflector plate 40 locked down. Fasteners 50 such as but not limited to rivets, screws and the like, can attach an adjustable locking hinge assembly 120 to both a steel type box mounting bracket 60 and the back of a prior art type canvas ammunition bag 30. The canvas ammunition pouch bag 30 can be made from a fabric material, such as but not limited to the pouch bags shown and described in U.S. Pat. Nos. 6,675,693 to Heayn and 6,799,500 to Kulikowski, which are both incorporated by reference. The deflector plate 40 can be formed from a solid molded material such as polymer, plastic and/or fiberglass. Alternatively, the angled plate 40 can be formed from metal such as aluminum, steel, galvanized steel, stainless steel and the like, or other combinations thereof. The plate 40 must be rigid enough to maintain an angled configuration when attached to the inner side of the pouch bag 30, and be strong enough to reshape the pouch bag 30.

FIG. 2 is a front perspective view of the ammunition holder 20 of FIG. 1 with a straight deflector plate 40 locked up at an angle, for example, approximately 40 degrees. Although this plate 40 is shown locked at approximately 40 degrees, the plate 40 can be configured to lock at any selected angle.

Figure 3:
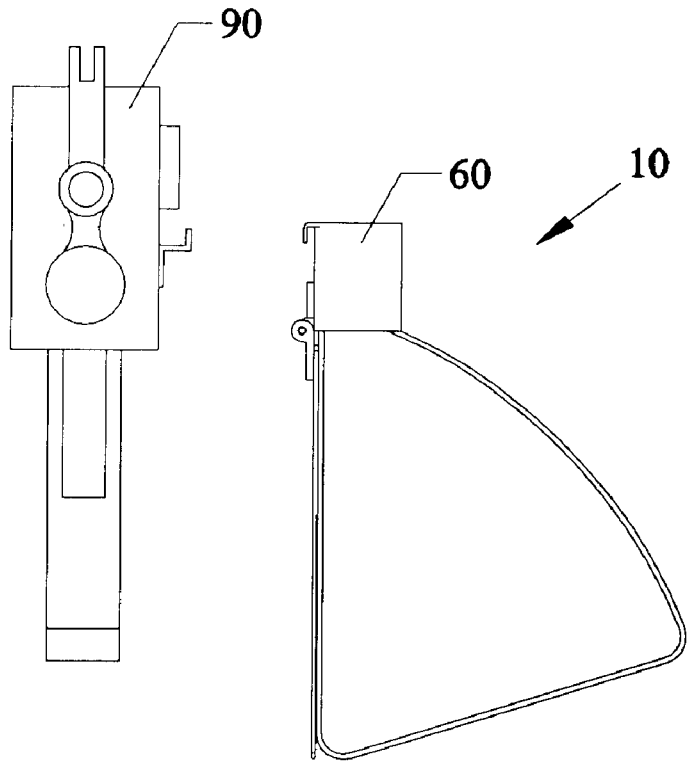
FIG. 3 is a front view of the ammunition holder of FIG. 1 with straight deflector plate ready to be installed on a gun.
Figure 4:
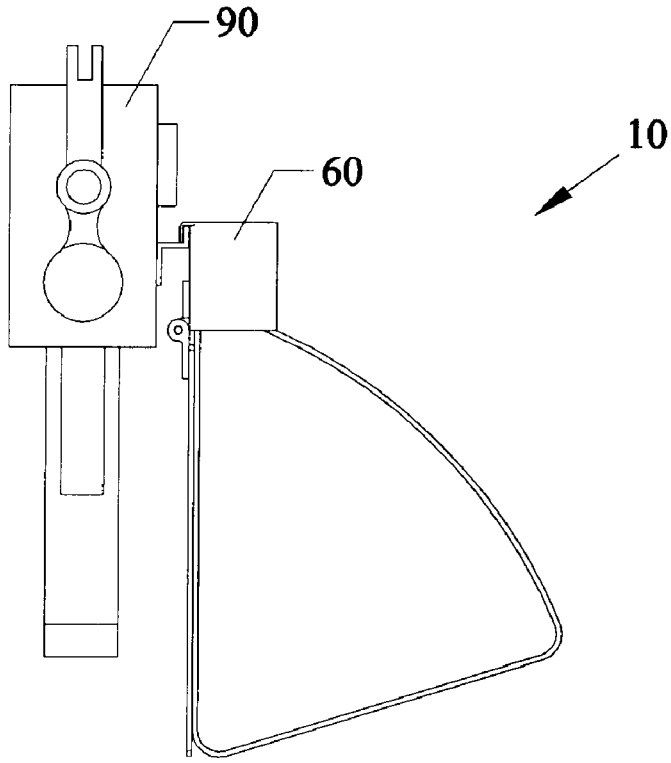
FIG. 4 is another front view of the ammunition holder of FIG. 1 installed on a gun.

FIG. 3 is a front view of the ammunition holder 10 of FIG. 1 with straight deflector plate and bracket 60 ready to be installed on a gun 90. The gun 90 can be a popular prior art machine gun such as a but not limited to a FN (Fabrique Nationale) Mag, the 240/Mag machine gun, the German MG3 machine gun. FIG. 4 is another front view of the ammunition holder 10 of FIG. 1 installed on a gun 90. Here the bracket 60 can be attached to the existing side hook on the gun 90.

Figure 5:
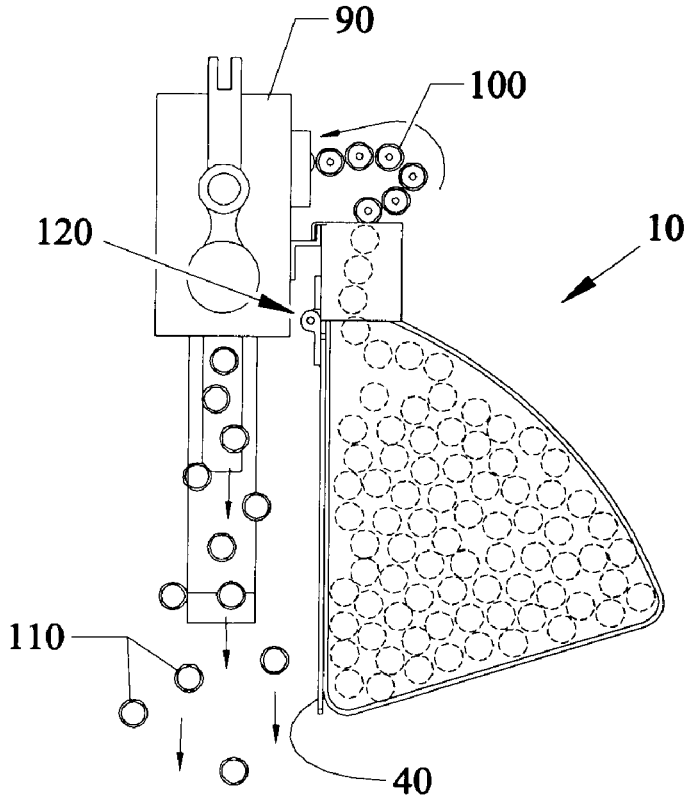
FIG. 5 shows the ammunition holder of FIG. 1 with straight deflector plate locked down installed on a gun with spent shells being ejected from the gun.

FIG. 5 shows the ammunition holder 10 of FIG. 1 with straight deflector plate 40 locked down by hinge 120 with holder 10 installed on a gun 90 with spent shells 110 being ejected from the gun 90. Ammunition can be chain fed 100 for cycling out of bag 30. This configuration can be used when the gun is mounted in a gun cradle.

Figure 6:
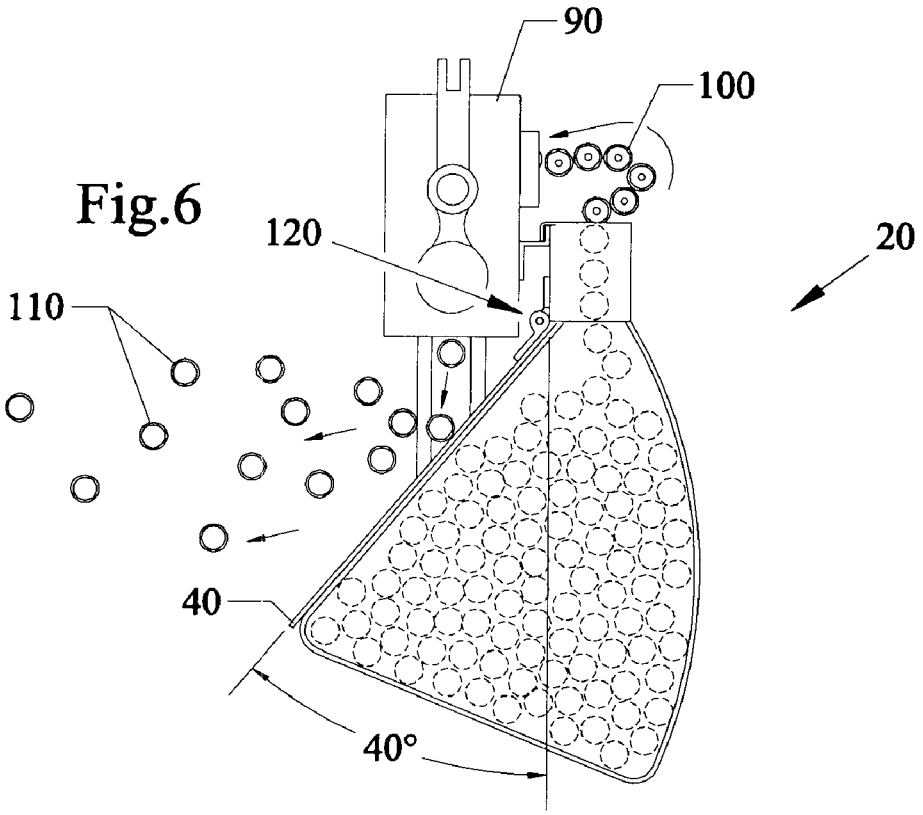
FIG. 6 is another view of FIG. 5 with the deflector plate locked up.

FIG. 6 is another view of FIG. 5 with the deflector plate 40 locked up by hinge 120 at an angle of approximately 40 degrees. Spent shells 110 can be deflected to the side of the gun 90 after ejection. This configuration is to move the center of gravity of the ammunition bag under the weapon 90 for ease of handling when being hung off of the gun cradle. Although the deflector plate 40 is shown locked at a approximately 40 degrees angle, the plate can be configured to lock at any selected angle.

Figure 7:
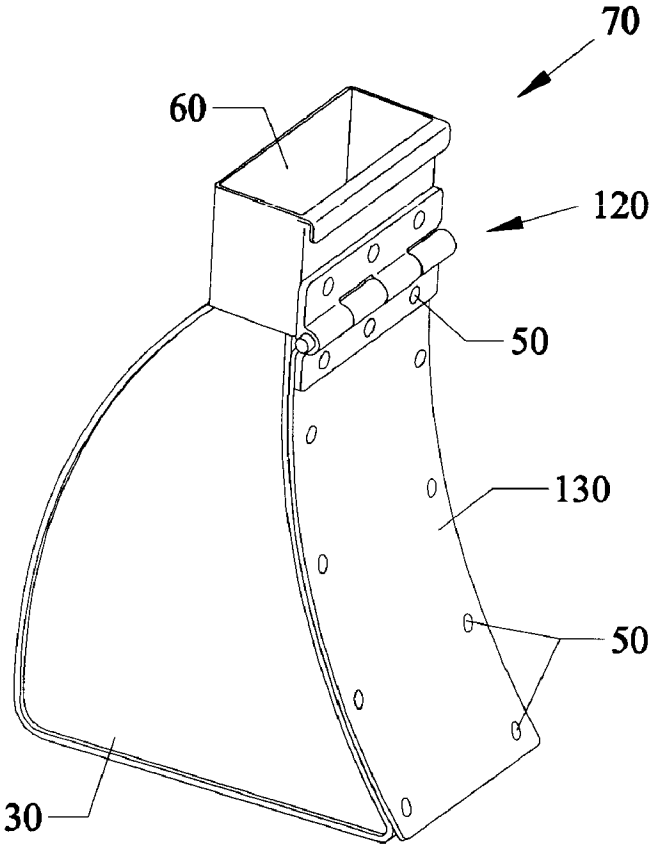
FIG. 7 is a front perspective view of the ammunition holder having a curved deflector plate locked down.

FIG. 7 is a front perspective view of the ammunition holder 70 having a curved deflector plate 130 locked down. Similarly, fasteners 50, such as rivets can attach the curved plate 130 and the hinge 120 to the side of a canvas type ammunition bag 30 and the steel type box mounting bracket 60. Curved deflector plate 130 can be formed from similar materials as plate 40 described above.

Figure 8:
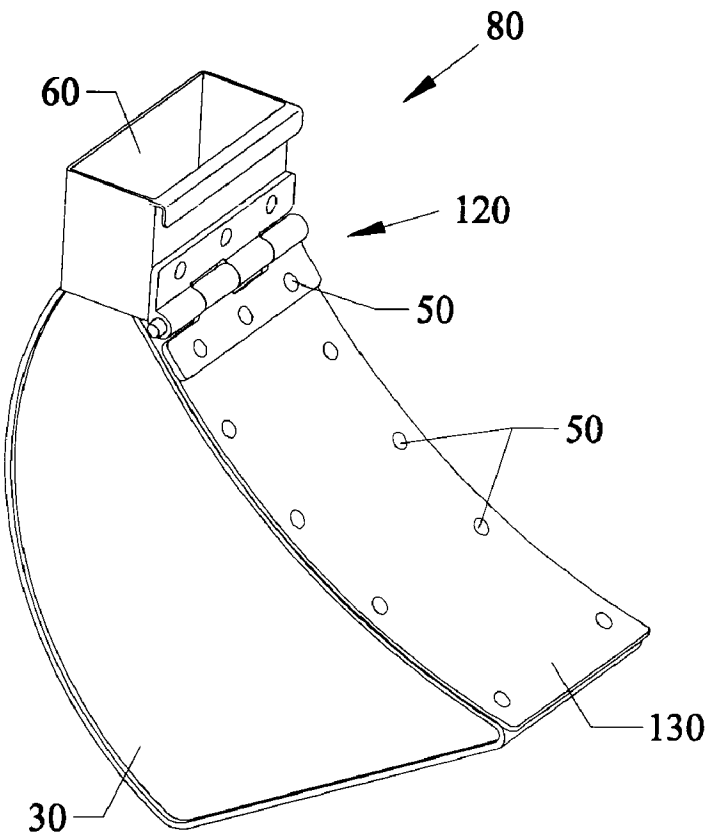
FIG. 8 is another view of FIG. 7 with the curved deflector plate locked up.

FIG. 8 is another view of FIG. 7 with the curved deflector plate 130 locked up by bending and locking hinge 120 which pulls one side of the bag 30. The curved plate 130 can be a concave curved surface.

Figure 9:
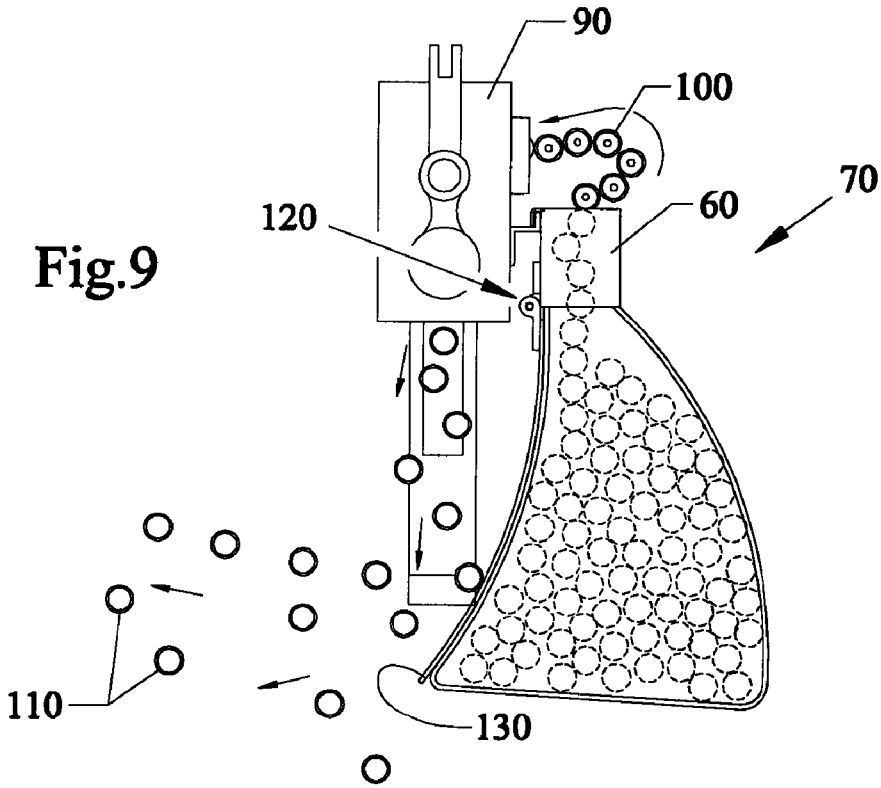
FIG. 9 is a front view of curved deflector plate of FIG. 7 locked down installed on a gun.

FIG. 9 is a front view of curved deflector plate 130 of FIG. 7 locked down by hinge 120 installed on a gun 90. A chain feed 100 can cycle ammunition shown out of bag 30 into gun 90 and the spent shells 110 and can be ejected out from under the gun 90. This configuration 70 can be used when the gun 90 is mounted in a gun cradle.

Figure 10:
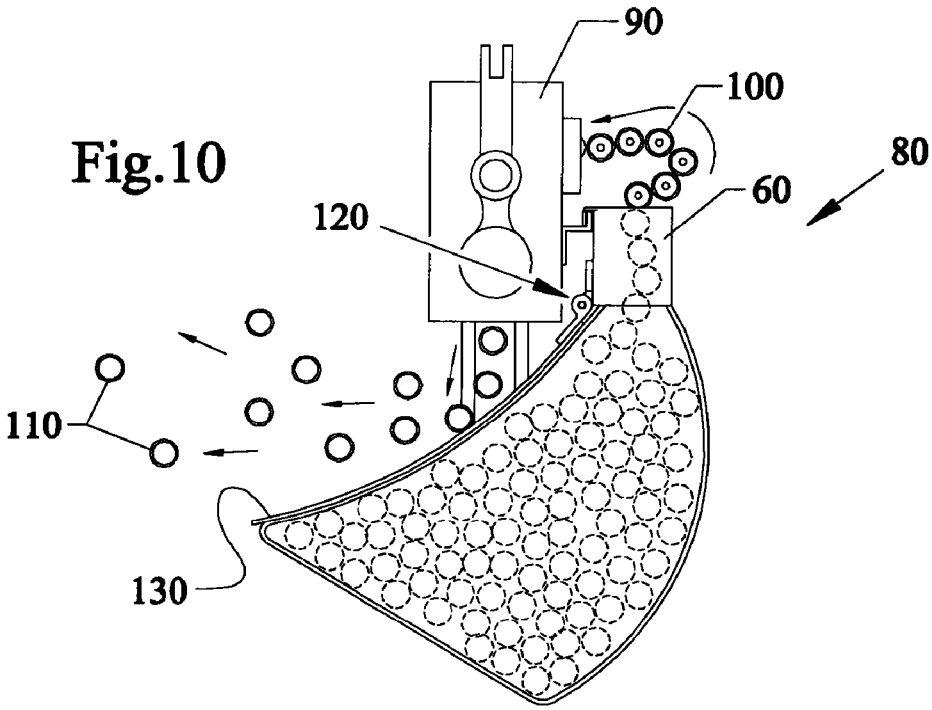
FIG. 10 is another view of FIG. 9 with the deflector plate locked up.

FIG. 10 is another view of FIG. 9 with the deflector plate 130 locked up by bending hinge 120 to a locked position. The spent shells 110 from the ammunition is shown being deflected to one side of the gun 90 after ejection. This configuration is to move the ammunition holder 80 center gravity under the weapon 90 for ease of handling when used off of the gun cradle. Although the deflector plate 130 is shown locked at approximately 40 degrees angle, the plate 130 can be configured to lock at any selected angle.

Figure 11:
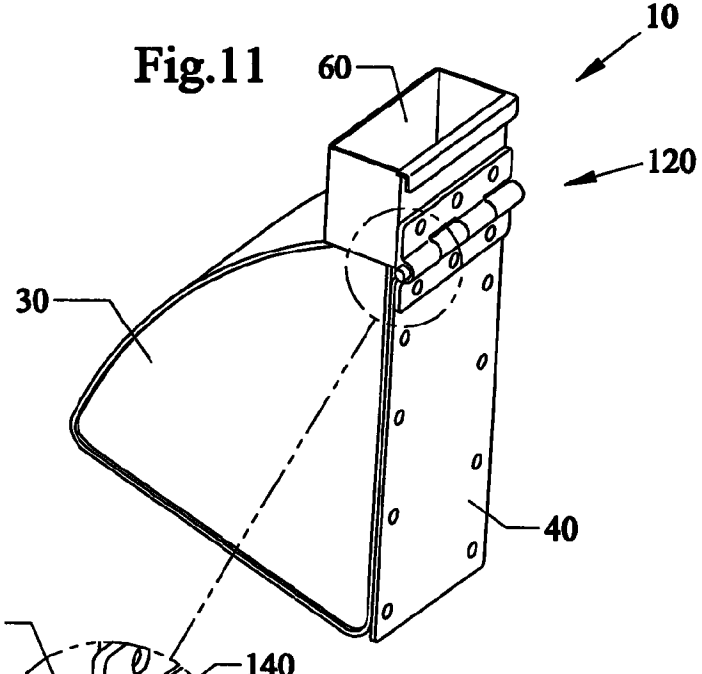
FIG. 11. Is another view of the ammunition holder of FIG. 1 with push button in open position.
Figure 11A:
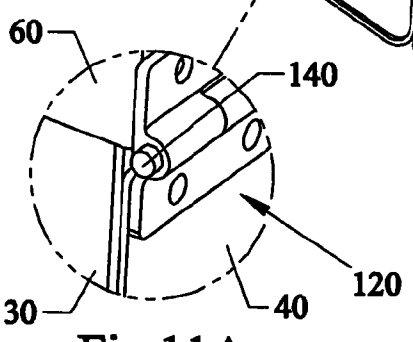
FIG. 11A is an enlarged view of the push button of the ammunition holder of FIG. 11.

FIG. 11. Is another view of the ammunition holder 10 of FIG. 1 with push button 140 on adjustable hinge 120 in an open position. Here, the hinge 120 and plate 40 are directly attached to an inner side of the bag 30 and bracket 60. FIG. 11A is an enlarged view of the push button 140 of the ammunition holder 10 of FIG. 11, showing the adjustably hinge mounted to the side of the bracket 60 and plate 40, the latter of which is directly attached to the inner side of the bag 30. With the button 140 out, the plate 40 is in a locked down position.

Figure 12:
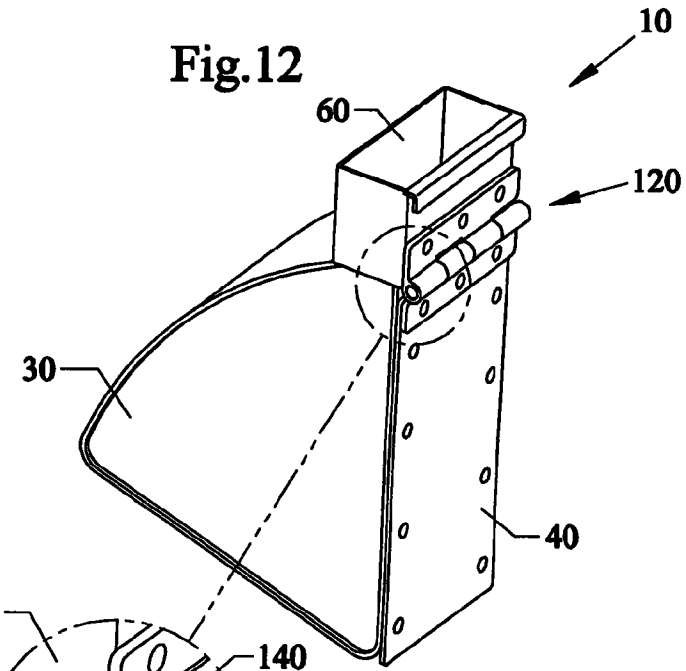
Figure 12A:
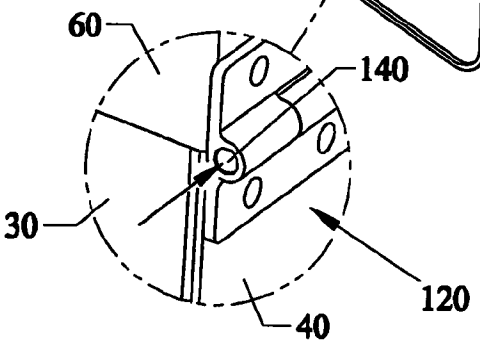
FIG. 12A is an enlarged view of the push button of FIG. 12.

FIG. 12 shows the ammunition holder 10 of FIG. 11 with push button 140 pressed into the hinge 120. FIG. 12A is an enlarged view of the push button 140 of FIG. 12. Once the button 140 is pressed in this unlocks the deflector plate 40 and allows the plate 40 to be free to pivot.

Figure 13:
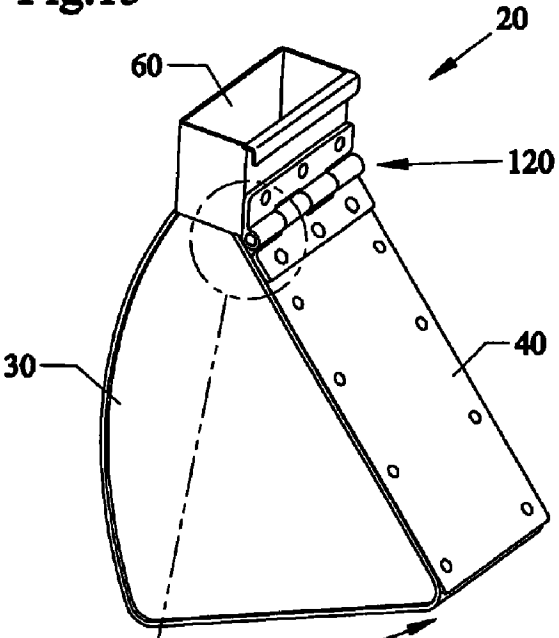
FIG. 13 shows the ammunition holder of FIG. 12 with the push button pressed in and the plate pivoted upward.
Figure 13A:
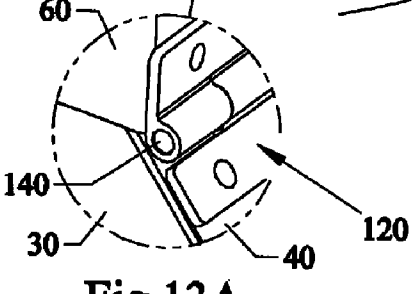
FIG. 13A is an enlarged view of the push button of FIG. 13.

FIG. 13 shows the ammunition holder 20 of FIG. 12 with the push button 140 pressed in and the plate 40 pivoted upward. FIG. 13A is an enlarged view of the pressed in push button 140 of FIG. 13. Here, the button 140 is pressed in and the plate 40 has been pivoted up. It is not necessary to hold the button 140 in while pivoting the plate 40. The button 140 can remain in a pressed in position until the adjustable hinge 120 has found the stop at the configured (selected) incremental angle (which can be such as but not limited to approximately 40 degrees).

Figure 14:
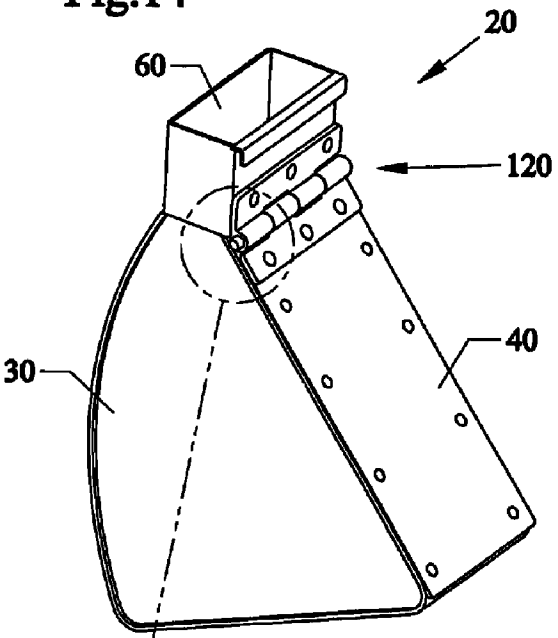
FIG. 14 shows the ammunition holder of FIG. 13 with push button popped (extended) outward locking the plate in position.
Figure 14A:
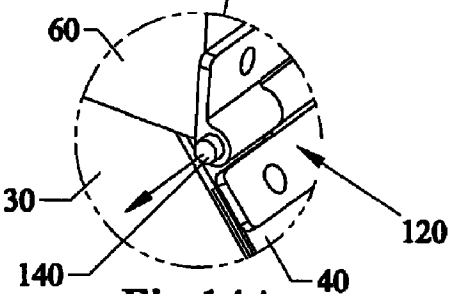
FIG. 14A is an enlarged view of the push button of FIG. 14.

FIG. 14 shows the ammunition holder 20 of FIG. 13 with push button 140 popped (extended) outward locking the plate 40 in position. FIG. 14A is an enlarged view of the push button 140 of FIG. 14. Here, the hinge 120 has found the stop at a selected angle of for example, approximately 40 degrees and the button 140 has popped out, locking the deflector plate 40 at the position shown.

Figure 15:
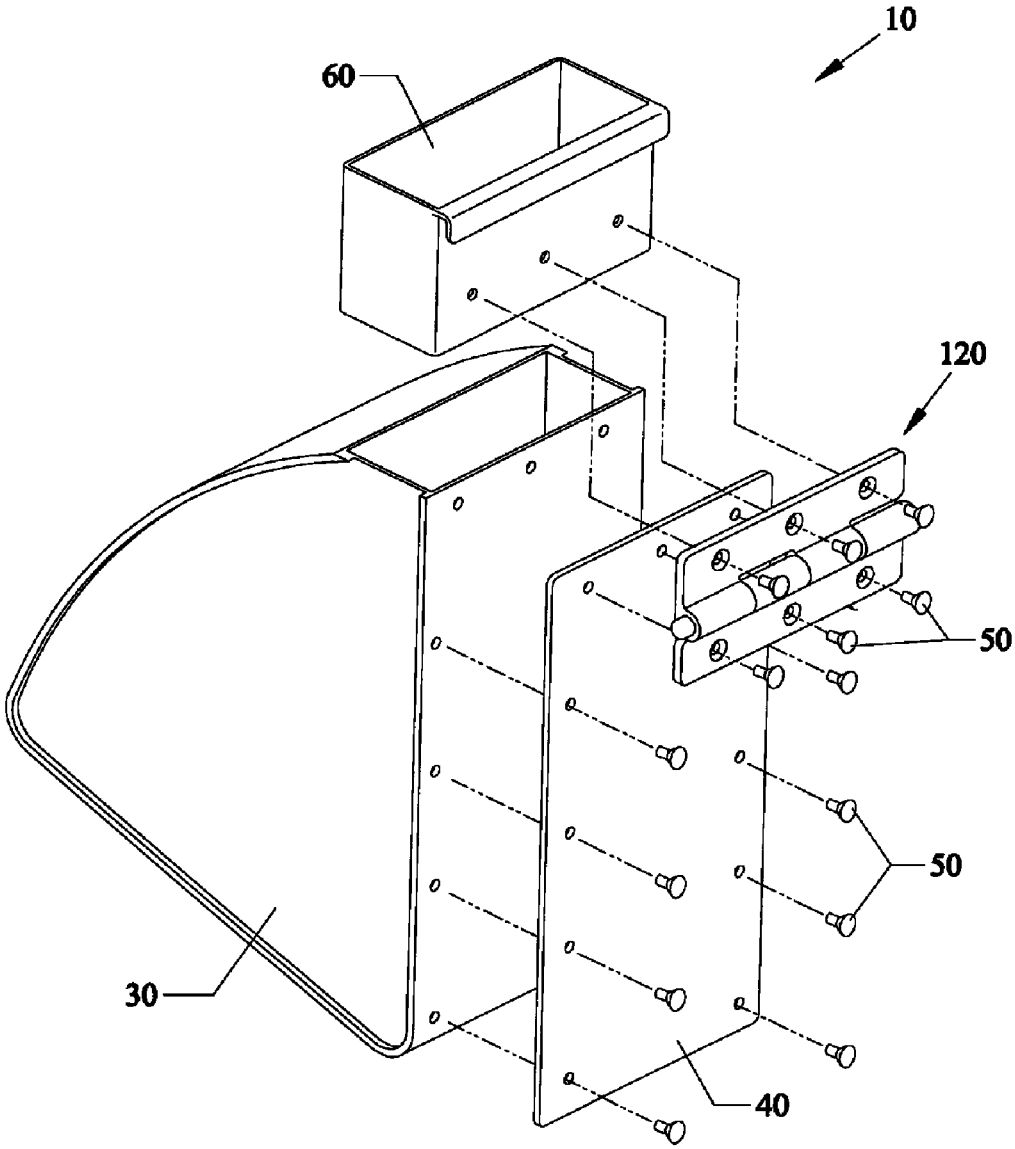
FIG. 15 is an exploded view of the ammunition holder of FIGS. 11-14A with push button.

FIG. 15 is an exploded view of the ammunition holder 10 of FIGS. 11-14A with push button. Here, the steel type box mounting bracket 60 spaced from the bag 30 and the deflector plate 40 and adjustable hinge 120 with fasteners 50, such as rivets. Although the exploded figure shows a straight deflector plate, the ammunition holder with a curved deflector plate can have similar components.

Figure 16:
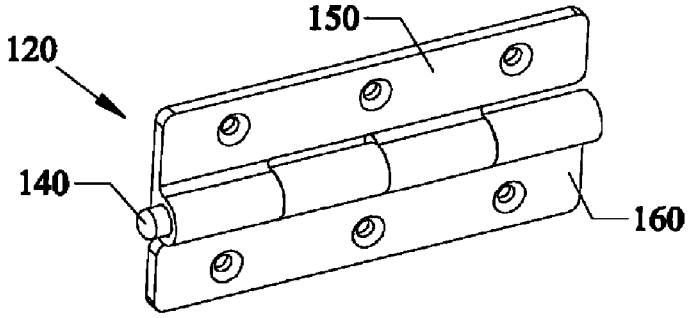
FIG. 16 is an enlarged view of the adjustable hinge of FIG. 11.

FIG. 16 is an enlarged view of the adjustable hinge 120 of FIG. 11 with button 140 popped out. The hinge 120 can include a first hinge leaf 150 interconnected with a second hinge leaf 160.

Figure 17:
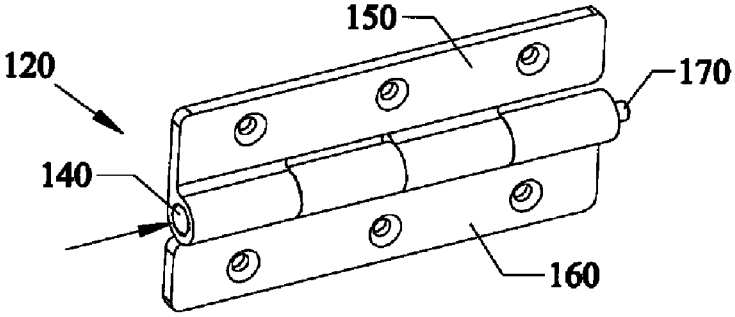
FIG. 17 is an enlarged view of the adjustable hinge of FIG. 12

FIG. 17 is an enlarged view of the adjustable hinge 120 of FIG. 12 with button 140 pushed inward, and opposite end of locking hinge pin 170 extending out from the opposite end of the adjustable hinge 120.

Figure 18:
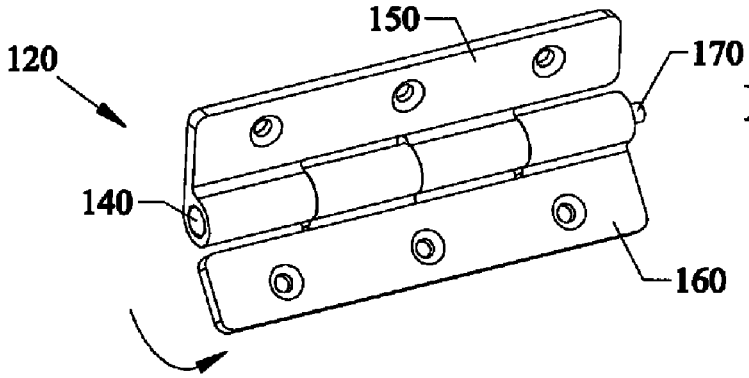
FIG. 18 is an enlarged view of the adjustable hinge of FIG. 13.

FIG. 18 is an enlarged view of the adjustable hinge 120 of FIG. 13 with second hinge leaf 160 pivoting upward relative to first hinge leaf 150 after the button 140 is pushed in to unlock the hinge 120. Locking hinge pin 170 is shown extending out from the opposite end of the adjustable hinge 120.

Figure 19:
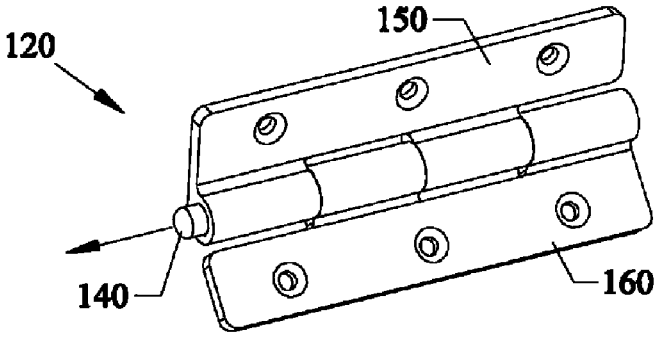
FIG. 19 is an enlarged view of the adjustable hinge of FIG. 14.

FIG. 19 is an enlarged view of the adjustable hinge 120 of FIG. 14 that when pivoted up to a stop becomes locked in place, and the button 140 is pushed out.

Figure 20:
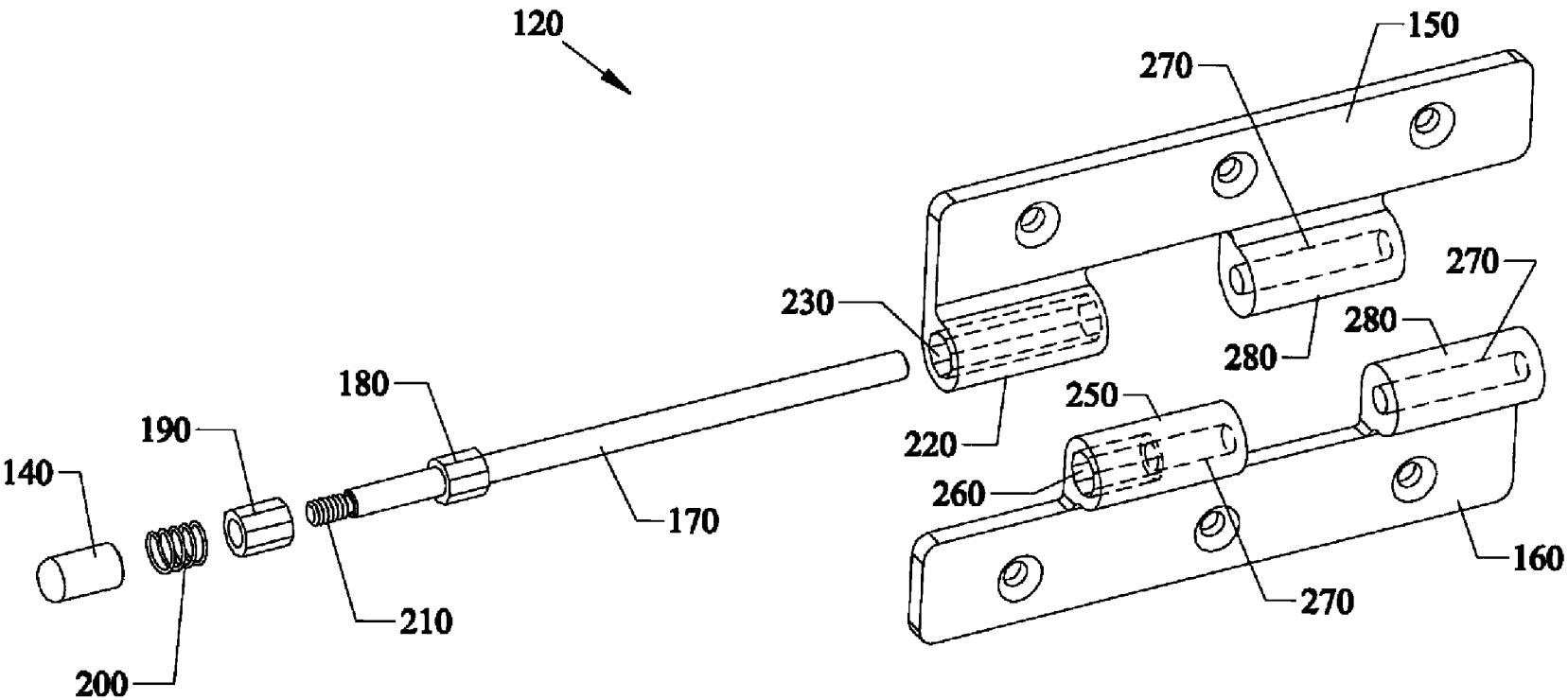
FIG. 20 is an exploded view of the hinge of FIGS. 16-19. Exploded view of the adjustable hinge assembly showing the components in some detail.

FIG. 20 is an exploded view of the adjustable hinge 120 of FIGS. 16-19. First hinge leaf 150 can have an hinge knuckle 220 at one end with only polygon shaped through hole 230 spaced from a hinge knuckle 280 with round hole 270 for the hinge pin 170. Adjustable hinge 120 can also include a second hinge leaf 160 having a hinge knuckle 250 located to fit between hinge knuckle 220 and hinge knuckle 280. Hinge knuckle 25 can include a polygon shaped counter-bore 260 in a front end that feeds into a narrower diameter round hole 270 for the hinge pin 170. Second hinge leaf 160 can include a rear end located hinge knuckle 280 with a round hole 270 for hinge pin 170.

Hinge pin 170 can have an elongated portion with a polygon shaped locking element 180. The number of sides on the locking element 180 can be changed to reconfigure for different adjustable angle increments. For example, 360 degrees with 9 sides can cause approximately 40 degrees of pivot between each stop. A polygon shaped press-in plug 190 can be positioned about and over the threaded end 210 of the pin 170 and slid up to be adjacent to polygon shaped locking element 180. A locking hinge pin return spring 200 such as a coil spring can be positioned about and over the threaded end 210 of the pin 170 to abut against the moveable polygon shaped press-in plug 190. The button 140 can have an exterior blunt tip with an opposite end having a cavity with internal threads that tightens about the exterior threads 210 of the pin 170.

Figure 22A:
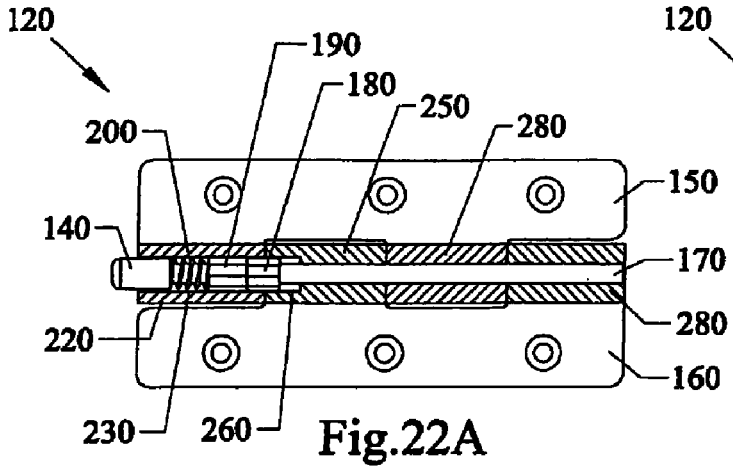
FIG. 22A is a cross-sectional view of the adjustable hinge of FIG. 21 along arrow 22X with button pushed out.
Figure 21:
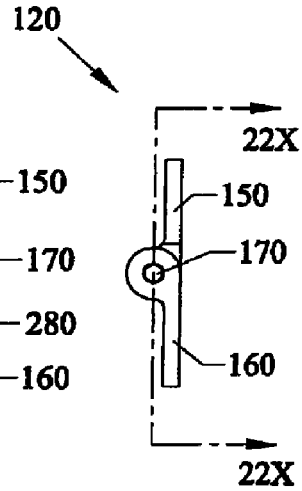
FIG. 21 is a right side view of adjustable hinge of the preceding figures.
Figure 22B:
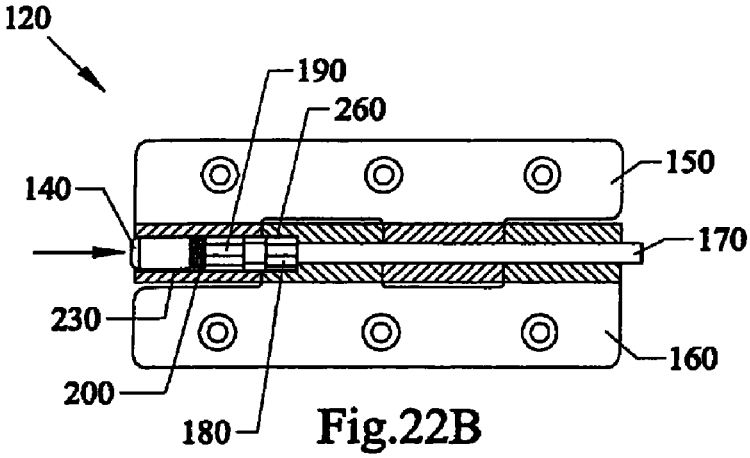
FIG. 22B is a cross-sectional view of the adjustable hinge of FIG. 21 along arrow 22X with button pushed out.
Figure 22C:
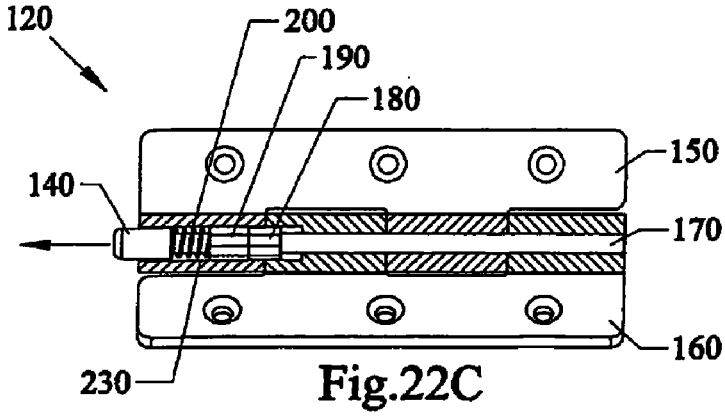
FIG. 22C is a cross-sectional view of the adjustable hinge of FIG. 21 along arrow 22X with the hinge partially closed in a locked position with button pushed out.

FIG. 21 is a right side view of adjustable hinge 120 of the preceding figures. FIG. 22A is a cross-sectional view of the adjustable hinge 120 of FIG. 21 along arrow 22X with button 140 pushed out. FIG. 22B is a cross-sectional view of the adjustable hinge 120 of FIG. 21 along arrow 22X with button 140 pushed out. FIG. 22C is a cross-sectional view of the adjustable hinge 120 of FIG. 21 along arrow 22X with the hinge 120 partially closed in a locked position with button 140 pushed out FIGS. 22A-22C show how the locking mechanism works: Referring to FIG. 22A, the lock button 140 is out (default lock position), and the polygon shaped locking element 180 that is a part of the lock pin 170 can be positioned to engage the polygon shaped holes 230, 260 in one knuckle from each of the two hinge leafs 150, 160. This locks the leafs 150, 160 together preventing them from pivoting about the hinge pin 170.

Referring to FIG. 22B, the lock button 140 in (unlock position) allows for the polygon shaped locking element 180 that is part of the lock pin 170 to be positioned to disengage from the polygon shaped hole in the knuckle of first leaf 150 thereby freeing the leafs 150, 160 to pivot about the hinge pin 170. Once the button 150 is pressed in and the hinge 120 is pivoted even slightly, the button 140 will remain in until the polygon shaped locking element 180 finds another position in which it realigns with the polygon shaped hole 260 in the knuckle of the first leaf 150.

Referring to FIG. 22C, when the locking element realigns with the hole in first leaf 150, the hinge pin 170 return spring 200 will return the locking hinge pin 170 to its default position of out (locked).

Figure 23:
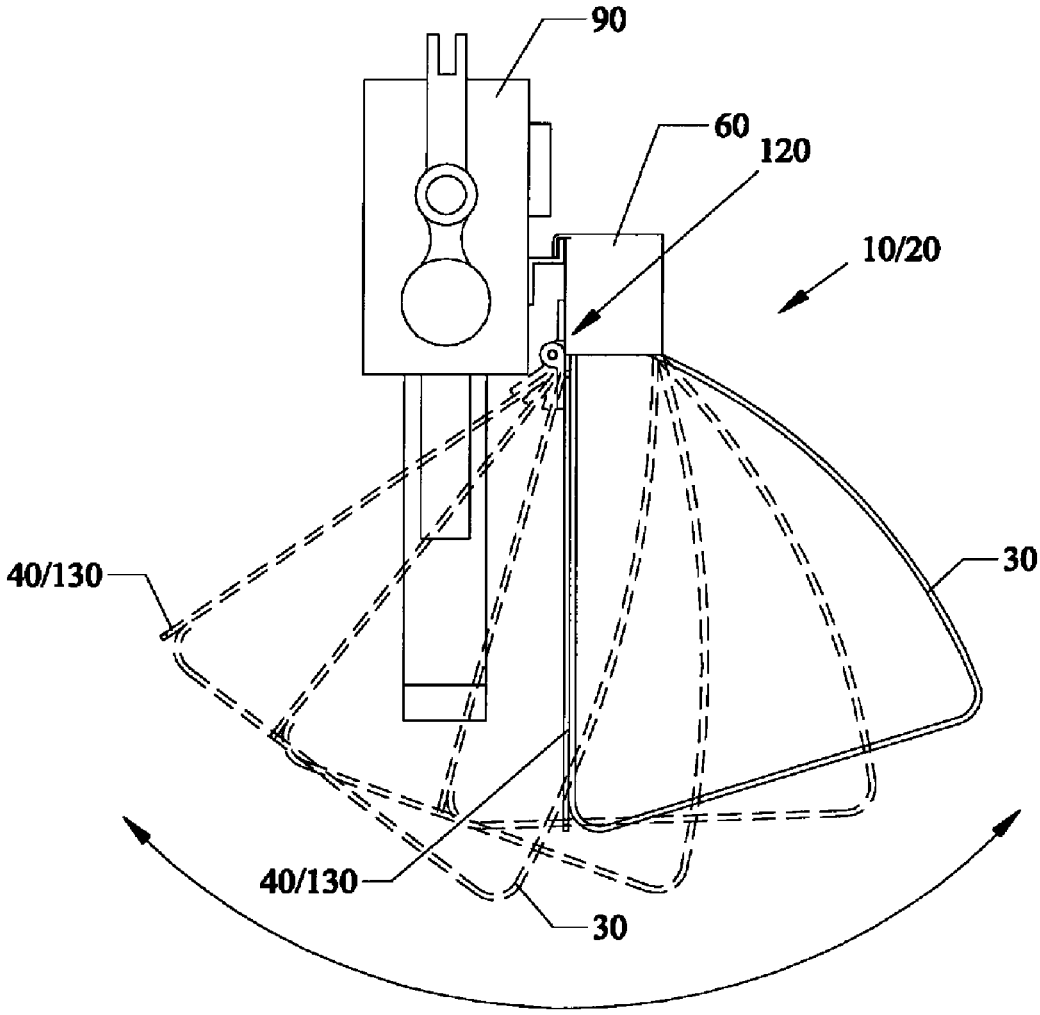
FIG. 23 is a front view of the ammunition holder mounted on gun demonstrating that the bag can be configured to lock at any angle.

FIG. 23 is a front view of the ammunition holder 10/20 mounted on a gun 90 with bracket 60 demonstrating that the bag 30 with deflector plate 40/130 can be configured to lock at any angle by adjustable hinge 120.

Figure 24:
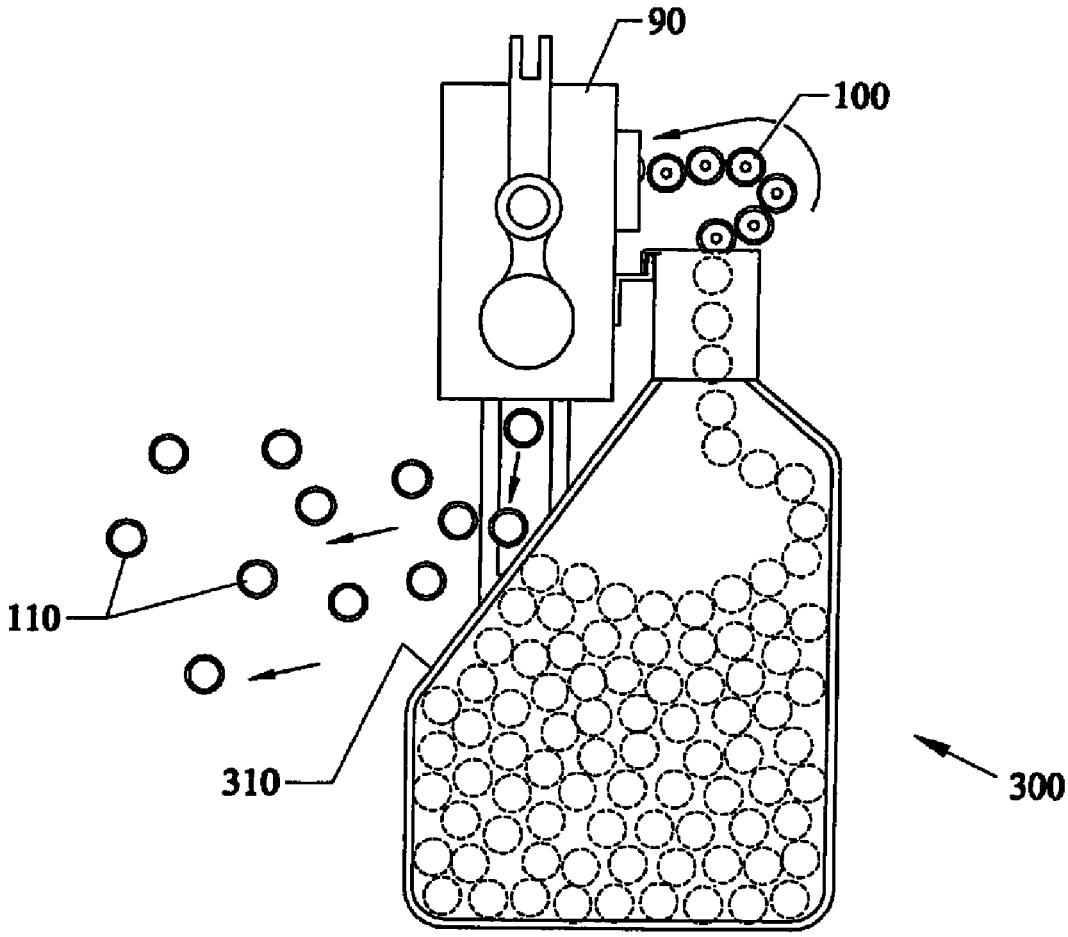
FIG. 24 is a front view of a hard sided ammunition holder box with center of gravity shifted under the gun.

FIG. 24 is a front view of a hard sided ammunition holder box 300 with center of gravity shifted under the gun 90 so that chain fed ammunition 100 being fed into the gun 90 has spent shells being ejected beneath the gun 90 and deflected to one side by angled inner side plate portion 310. The box 300 can be preformed or molded to have a deflector plate 310 that can be angled. Alternatively, the plate 310 can have a concave curved surface. The deflector plate 310 can allow for the spent shells 110 to be deflected to one side of the gun 90. Although the box 300 is described as aluminum, the box can be made from other rigid type materials such as those described above for the deflector plates 40/130. For example, the box 300 can be made from molded plastic, and other rigid materials and the like.

Figure 25:
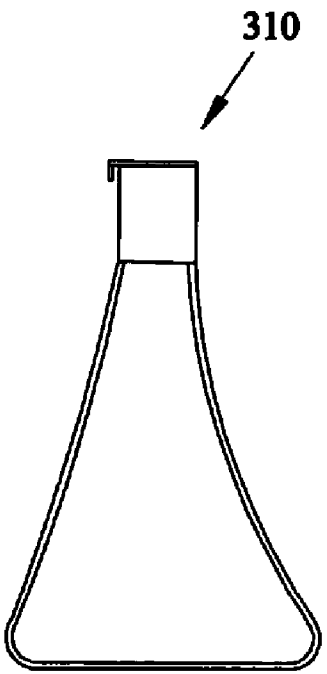
Fig.25 (Prior Art)
FIG. 25 is a view of a prior art canvas ammunition bag.

FIG. 25 is a view of a prior art canvas ammunition pouch bag 310 that can be made from a fabric material, such as but not limited to the pouch bags shown and described in U.S. Pat. Nos. 6,675,693 to Heayn and 6,799,500 to Kulikowski, which are both incorporated by reference.

Figure 27:
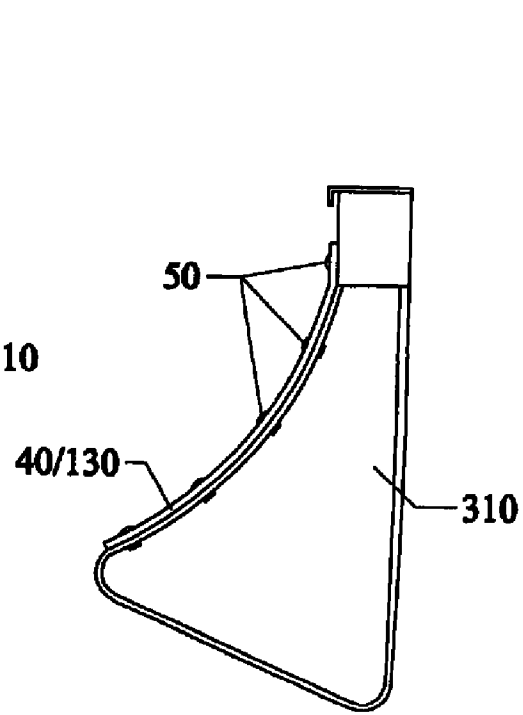
FIG. 27 is a view of the canvas ammunition bag of FIG. 26 with a fastener based conversion kit installed.
Figure 26:
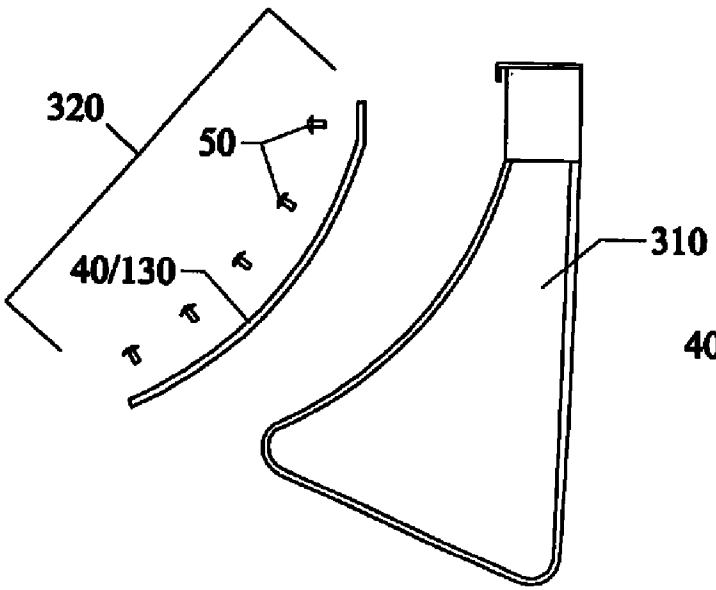
FIG. 26 is a view of the canvas ammunition bag of FIG. 25 with a fastener based conversion kit ready to install.

FIG. 26 is a view of the canvas ammunition bag 30 of FIG. 25 with a fastener based conversion kit ready to install. A fastener conversion kit 320 can include fasteners 50 such as but not limited to rivets, screws, and the like, and deflector plate 40/130 that can be straight or concave curved. FIG. 27 is a view of the canvas ammunition bag 310 of FIG. 26 with a fastener based conversion kit 320 installed. Once the plate 40/130 is installed on an inner side of the bag 310, the shape of the bag 310 changes so that one side of the bag 310 is moved toward one side.

Figures 28, 29, 30:
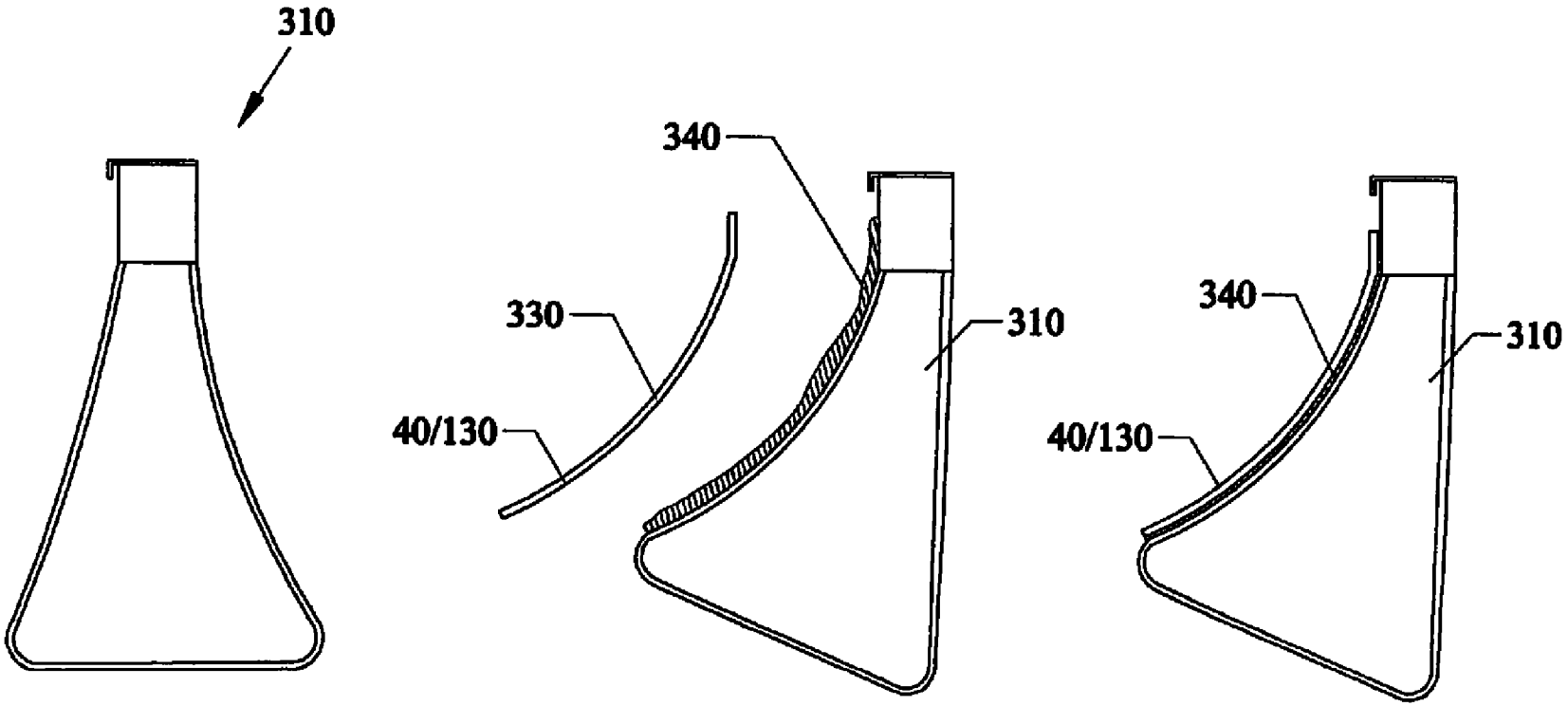
Fig.28 (Prior Art)
FIG. 28 is a view of a prior art canvas ammunition bag.
FIG. 29 is a view of the canvas ammunition bag with a glue-on based conversion kit ready to install.
FIG. 30 is a view of the canvas ammunition bag of FIG. 29 with a glue-on based conversion kit installed.
Figure 32:
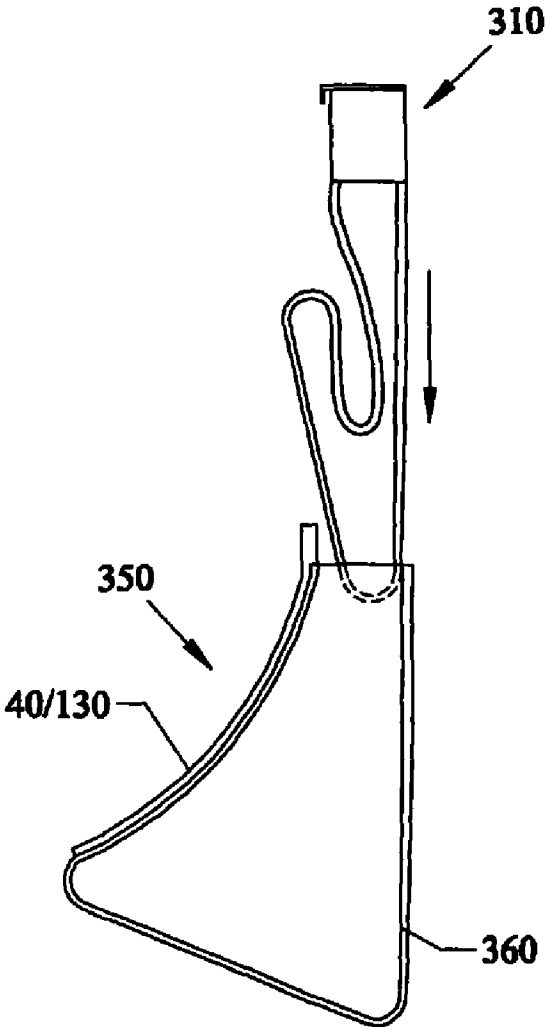
FIG. 32 is a view of a folded version of the canvas ammunition bag of FIG. 31 being slipped into a slip-on containment based conversion kit.
Figure 31:
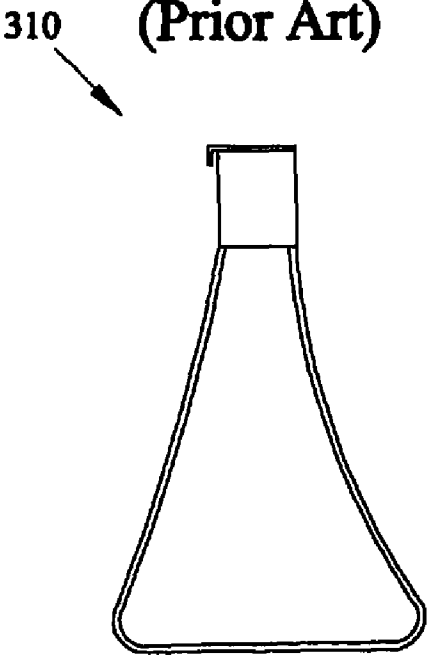
Fig.31 (Prior Art)
FIG. 31 is a view of a prior art canvas ammunition bag.

FIG. 28 is a view of a prior art canvas ammunition bag 310. FIG. 29 is a view of the canvas ammunition bag 310 with an adhesive/glue-on based conversion kit ready to install. The kit 330 can include an adhesive 340 such as glue with deflector plate 40/130. FIG. 30 is a view of the canvas ammunition bag of FIG. 29 with a glue-on based conversion kit 340 and 40/130 installed on the inner side of the bag 310. The adhesive can be glue or some other type of adhesive FIG. 31 is a view of a prior art canvas ammunition bag 310. FIG. 32 is a view of a folded version of the canvas ammunition bag 310 of FIG. 31 being slipped into an upper open end of a slip-on containment based conversion kit 350. The kit 350 can include a pre-formed shell 360 that can be a soft or hard slip-over container having an inner side with built on deflector plate 40/130.

Figure 33:
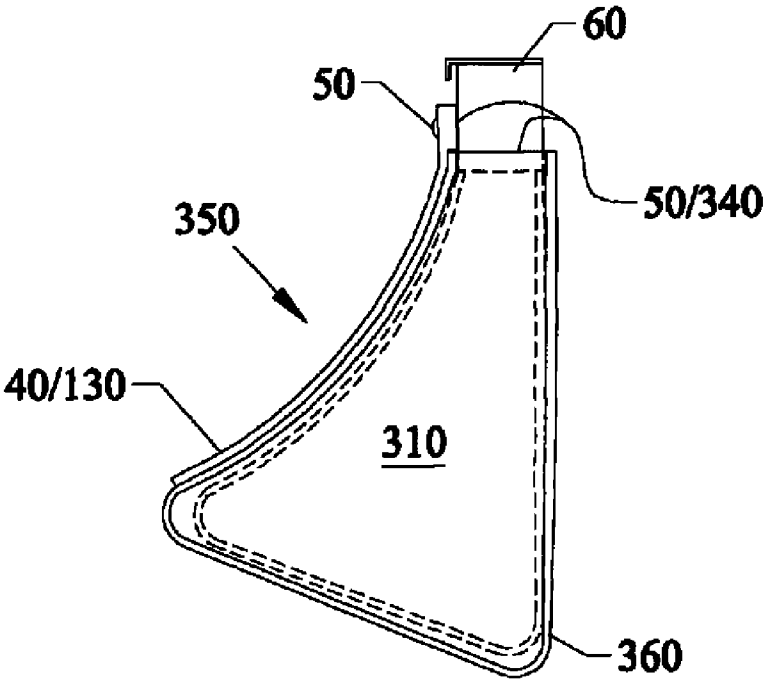
FIG. 33 is a view of the canvas ammunition bag inserted into the slip-on containment conversion kit of FIG. 32 that is now glued and/or screwed to the slip-on container of the kit.

FIG. 33 is a view of the canvas ammunition bag 310 inserted into the slip-on containment conversion kit 350 of FIG. 32 that is now glued and/or screwed to the slip-on container of the kit. A steel box mounting bracket 60 can be attached to the upper mouth end of the kit 350 and bag 310 by glue 340, and fasteners 50 and the like.

Figure 34:
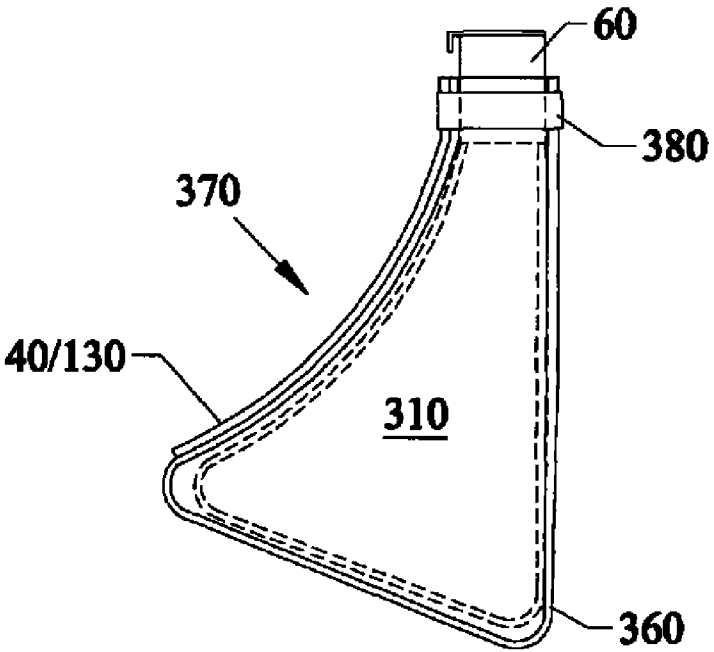
FIG. 34 is a view of the canvas ammunition bag inserted into the slip on containment conversion kit of FIG. 32 and strapped onto the slip-on container of the kit.

FIG. 34 is a view of the canvas ammunition bag 310 inserted into the slip on containment conversion kit 370 of FIG. 32 and strapped onto the slip-on container of the kit by strap 380 which attaches the mounting bracket 60 to the upper mouth end of the kit 370 and bag 310.

Figure 35:
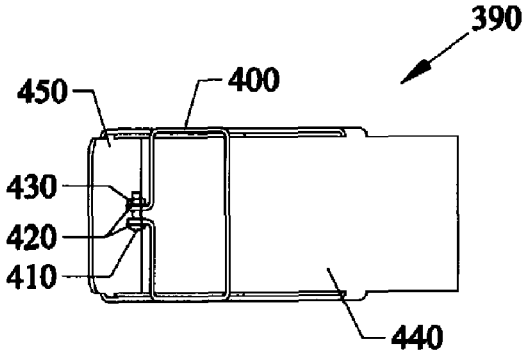
FIG. 35 is a top view of a clamp-on conversion frame with flat deflection plate.
Figure 36:
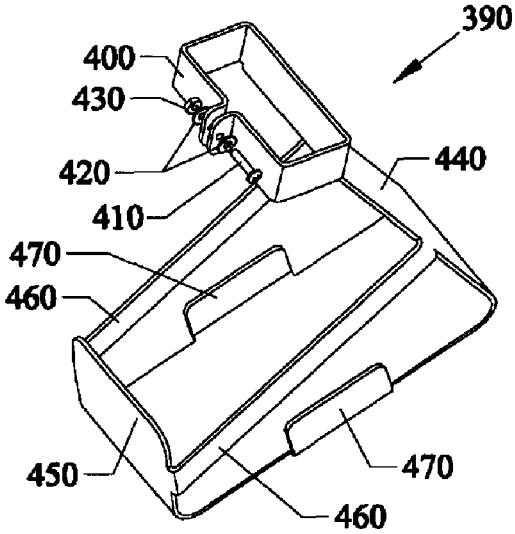
FIG. 36 is a perspective view of the clamp-on conversion frame of FIG. 35 with flat deflection plate.
Figure 37:
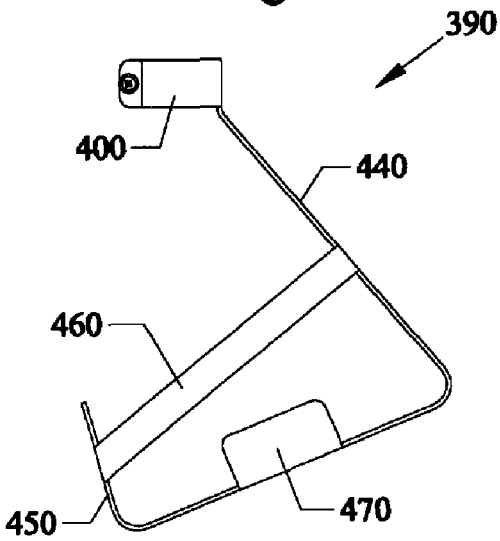
FIG. 37 is a front view of the clamp-on conversion frame of FIGS. 35-36 with flat deflection plate.
Figure 38:
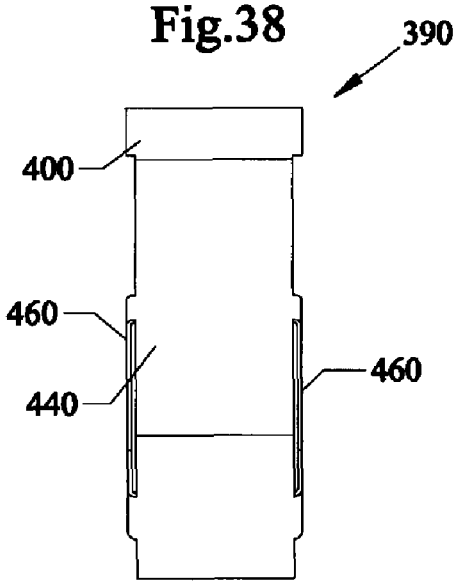
FIG. 38 is a side view of clamp-on conversion frame of FIGS. 35-37 with flat deflection plate.

FIG. 35 is a top view of a clamp-on conversion frame 390 with flat deflection plate. Frame 390 can have a conversion frame clamp 400 with clamp screw 410 which fastens together clamp tab ends of clamp 400 with a clamp nut 430 and washers 420. FIG. 36 is a perspective view of the clamp-on conversion frame of FIG. 35 with flat deflection plate 440, and conversion frame bag repositioning flange 450, ammo bag containment gusset 460 and ammo bag containment flange 470. FIG. 37 is a front view of the clamp-on conversion frame 490 of FIGS. 35-36 with flat deflection plate 440. FIG. 38 is a side view of clamp-on conversion frame 390 of FIGS. 35-37 with flat deflection plate 440.

Figure 41:
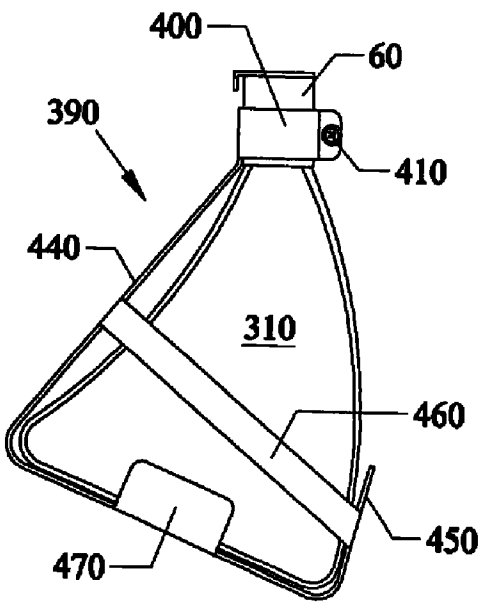
FIG. 41 is a side view of the canvas ammo bag installed in clamp-on conversion frame of FIGS. 39-40 with straight deflector plate.
Figure 40:
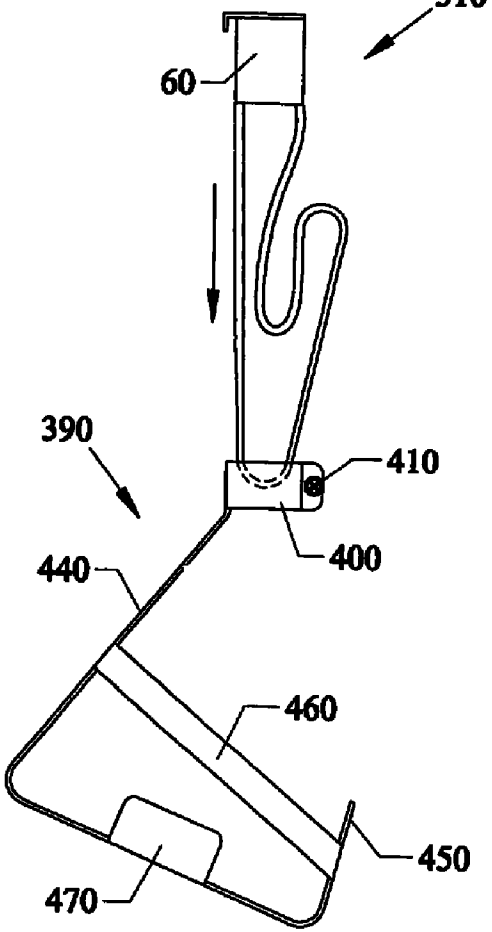
FIG. 40 is a side view of a folded canvas ammunition bag of FIG. 39 slipping into a clamp-on conversion frame with straight deflector plate.
Figure 39:
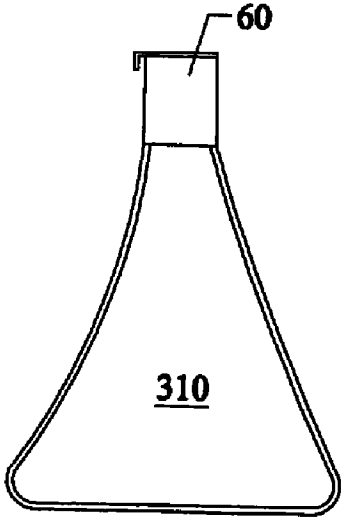
Fig.39 (Prior Art)
FIG. 39 is a view of a canvas ammunition bag of the prior art.
Figure 43:
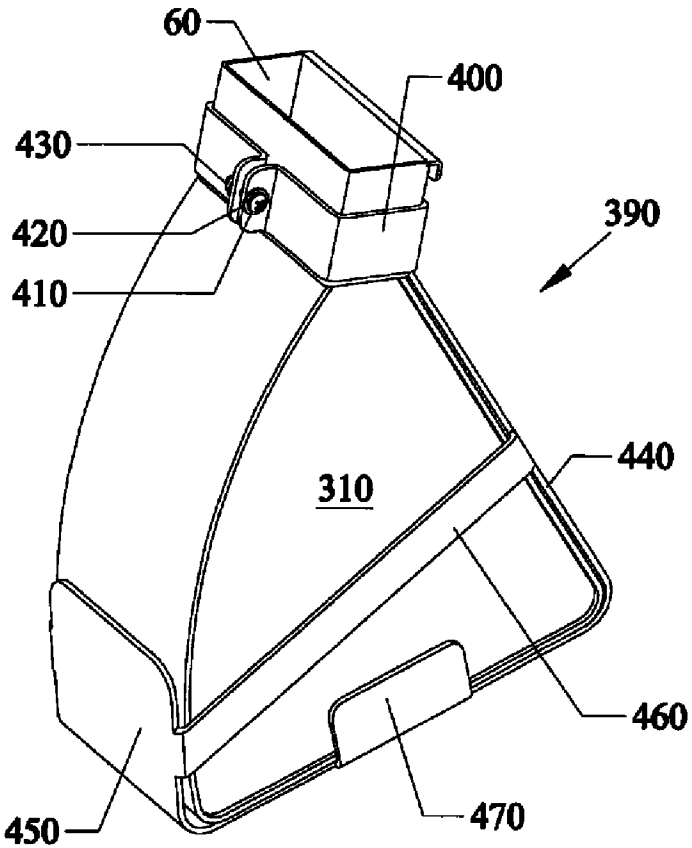
FIG. 43 is a rear perspective view of FIG. 42 of clamp-on conversion frame with straight plate and installed ammunition bag.
Figure 42:
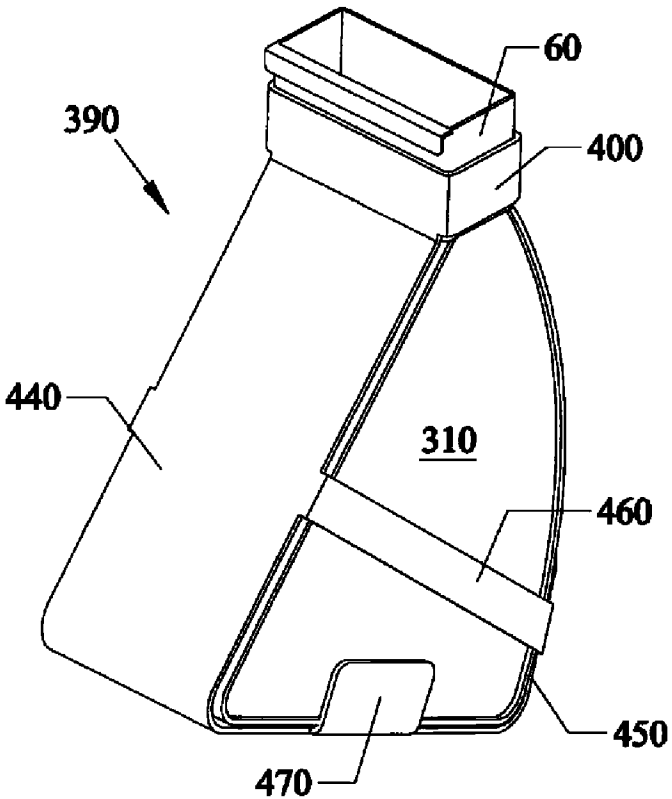
FIG. 42 is a front perspective view of the clamp-on conversion frame with straight plate and installed ammunition bag of FIGS. 40-42.

FIG. 39 is a view of a canvas ammunition bag 310 with mounting bracket 60 of the prior art. FIG. 40 is a side view of a folded canvas ammunition bag 310 and bracket 60 of FIG. 39 slipping into a clamp-on conversion frame 390 with straight deflector plate 440, where the bottom of the folded bag 310 fits into the conversion frame clamp 400 (held closed by the clamp screw 410. FIG. 41 is a side view of the canvas ammo bag 310 installed in clamp-on conversion frame 390 of FIGS. 39-40 with straight deflector plate 440 and held inside frame 390 by repositioning flange 450, containment gusset 460 and containment flange 470. The bracket 60 is supported within the conversion frame clamp 400 and clamp screw 410. FIG. 42 is a front perspective view of the clamp-on conversion frame 390 with straight plate 440 and installed ammunition bag 310 of FIGS. 40-42. FIG. 43 is a rear perspective view of FIG. 42 of clamp-on conversion frame 390 with straight plate 440 and installed ammunition bag 310.

Figure 44:
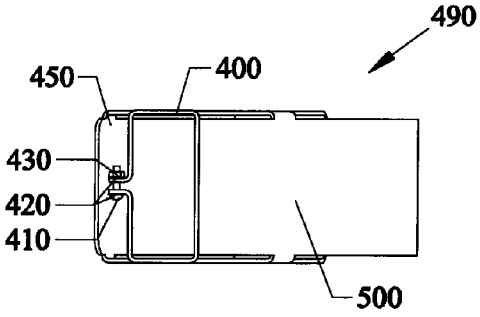
FIG. 44 is a top view of the clamp-on conversion frame of FIG. 35 with curved deflection plate.
Figure 45:
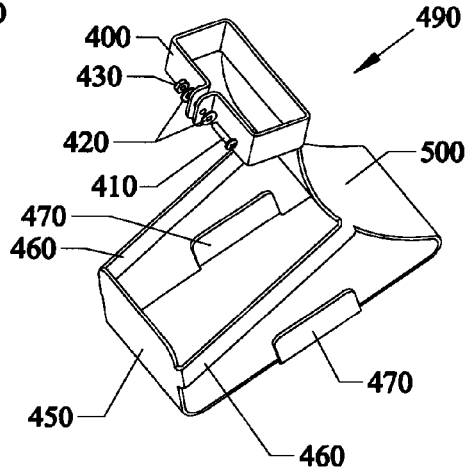
FIG. 45 is a perspective view of the clamp-on conversion frame of FIG. 44 with curved deflection plate.
Figure 46:
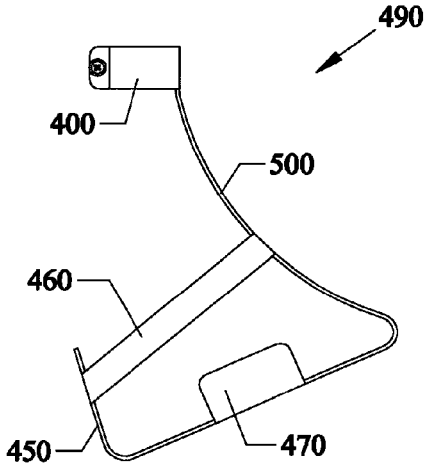
FIG. 46 is a front view of the clamp-on conversion frame of FIG. 44 with curved deflection plate.
Figure 47:
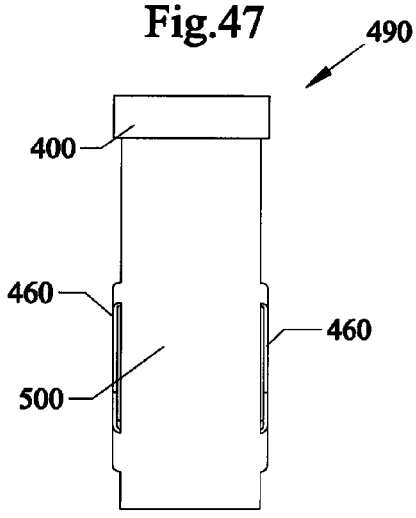
FIG. 47 is a side view of the clamp-on conversion frame of FIG. 44 with curved deflection plate.

FIG. 44 is a top view of the clamp-on conversion frame 490 of FIG. 35 with curved deflection plate 500. The other components are similar to and correspond to like numbered components of the preceding figures. FIG. 45 is a perspective view of the clamp-on conversion frame 490 of FIG. 44 with curved deflection plate 500. FIG. 46 is a front view of the clamp-on conversion frame 490 of FIG. 44 with curved deflection plate 500. FIG. 47 is a side view of the clamp-on conversion frame 490 of FIG. 44 with curved deflection plate 500.

Figure 50:
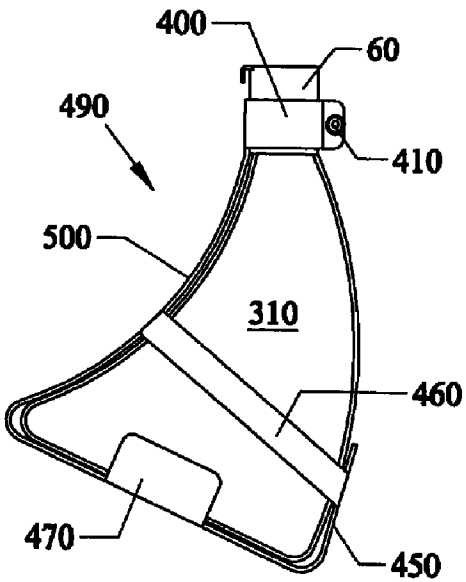
FIG. 50 is a side view of the canvas ammunition bag installed in clamp-on conversion frame with curved deflector plate of FIG. 49.
Figure 49:
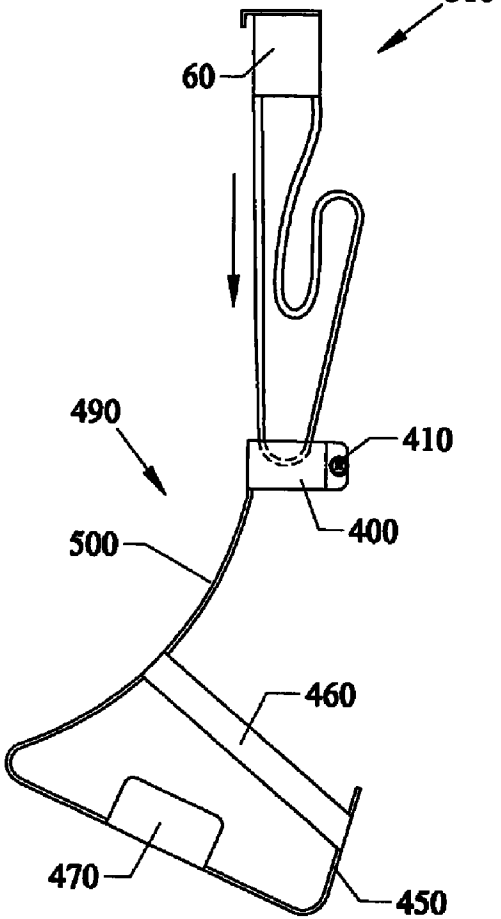
FIG. 49 is a side view of a folded canvas ammunition bag of FIG. 48 slipping into a clamp-on conversion frame with curved deflector plate.
Figure 48:
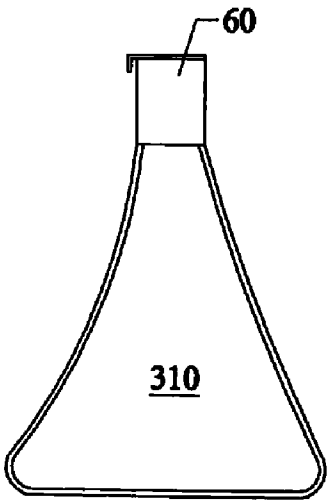
Fig.48 (Prior Art)
FIG. 48 is view of the canvas ammunition bag of the prior art.
Figure 52:
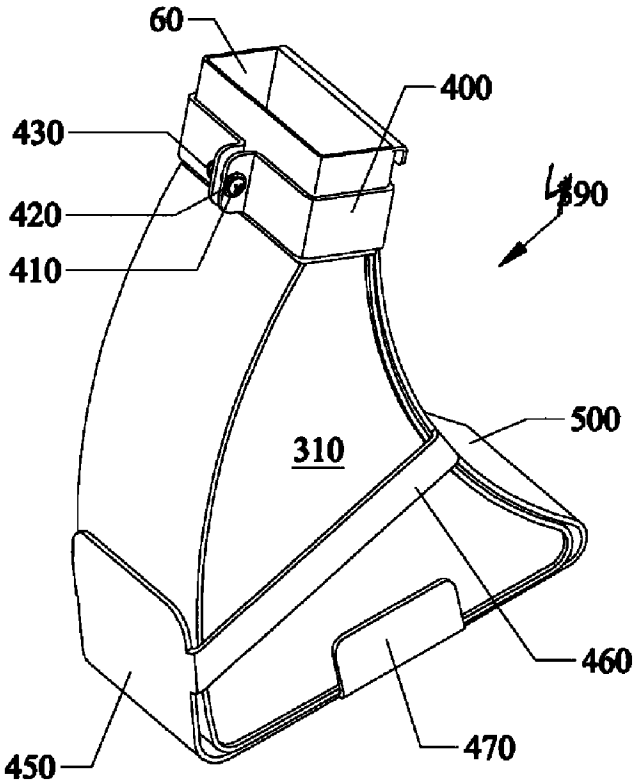
FIG. 52 is a rear perspective view of the clamp-on conversion frame with curved deflector plate and installed ammo bag.
Figure 51:
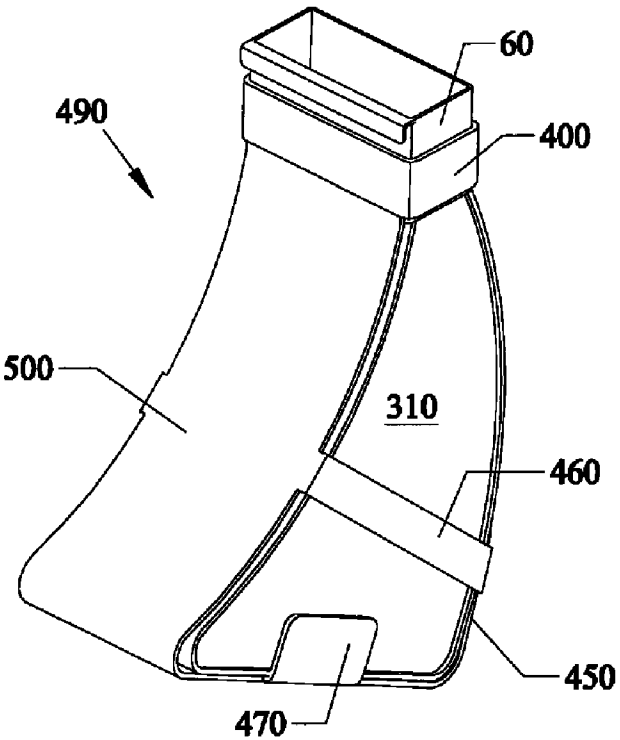
FIG. 51 is a front perspective view of the clamp-on conversion frame with curved deflector plate of FIG. 50 and installed ammunition bag.

FIG. 48 is view of the canvas ammunition bag 310 and bracket 60 of the prior art. FIG. 49 is a side view of a folded canvas ammunition bag 310 of FIG. 48 slipping into a clamp-on conversion frame 490 with curved deflector plate 500. FIG. 50 is a side view of the canvas ammunition bag 310 installed in clamp-on conversion frame 490 with curved deflector plate 500 of FIG. 49. The bag 310 can be installed in the frame 490 similar to the installation in the previous figures FIG. 51 is a front perspective view of the clamp-on conversion frame 490 with curved deflector plate 500 of FIG. 50 and installed ammunition bag 310. FIG. 52 is a rear perspective view of the clamp-on conversion frame 490 with curved deflector plate 500 and installed ammo bag 310.

Figure 53:
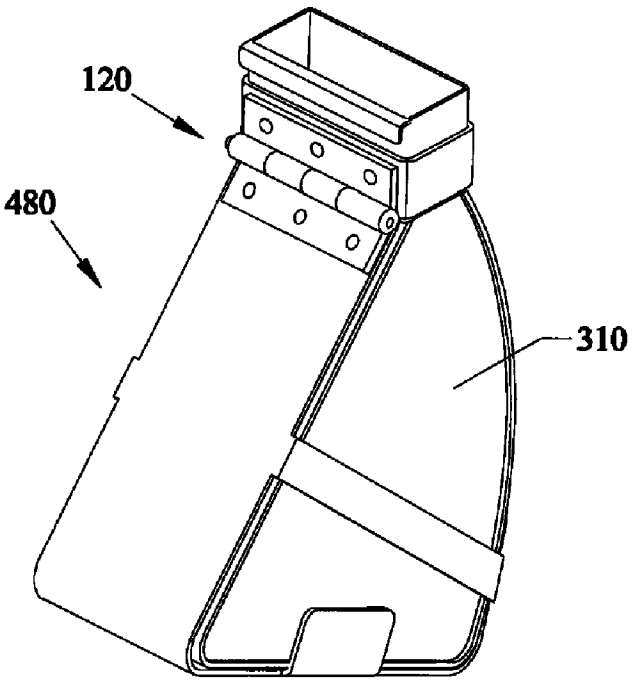
FIG. 53 is a front perspective view of the clamp-on kit with adjustable locking hinge with straight plate. Only the straight deflector plate is shown.

FIG. 53 is a front perspective view of the clamp-on kit 480 with adjustable locking hinge 120 with straight plate inner side. The hinge 120 can be used with the different frames previously shown and described. While only the straight deflector plate is shown. the curved plate can also be used as well.

Figure 54:
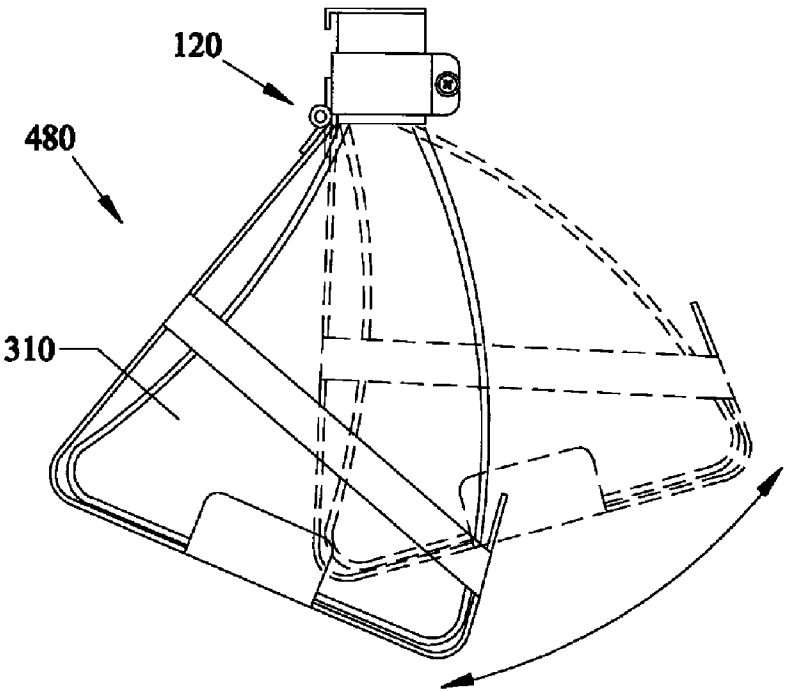
FIG. 54 is a side perspective view of clamp-on kit with adjustable hinge of FIG. 53 showing how the deflector plate can be adjusted. Only the straight deflector plate is shown.

FIG. 54 is a side perspective view of clamp-on kit 480 with adjustable hinge 120 of FIG. 53 showing how the deflector plate can be adjusted to different locked in deflection angles. While, only the straight deflector plate is shown, the curved plate can also be used as well.

Figure 55:
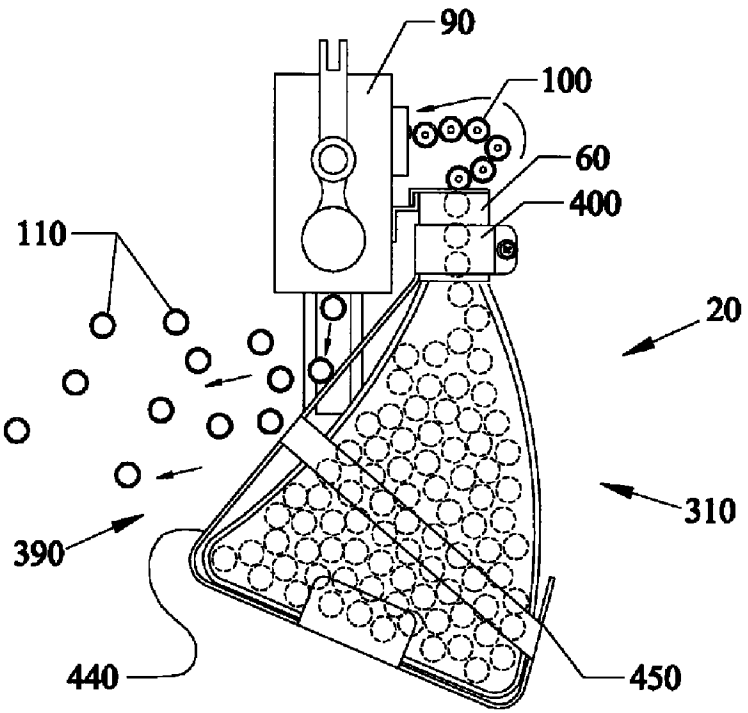
FIG. 55 shows the ammunition bag with clamp-on kit installed on a gun.

FIG. 55 shows the ammunition bag 310 with clamp-on kit installed on a gun 90. Spent cartridges/shells 110 ejecting from beneath the gun can be deflected sideways away from the gun 90.

Although the drawings show a bracket for holding the ammunition holder to the side of the weapon, the invention can be attached to the weapon with other types of mounts and fasteners, and is not limited to clipping the holder as shown by the drawings.

The novel deflection plates are able to move the center of gravity of the mass and weight of the supported ammunition rounds to be moved generally beneath the machine gun until a balance of the bag holder is achieved relative to the machine gun. This novel configuration removes the tilting and off-balance problems and resulting reorientation problems with using the machine gun 1 that were described in the background section of the invention.

The invention combines the ammunition box/holder as a deflector along with holding the center of gravity of the mass of the ammunition box/holder underneath the weapon.

While the invention references an angle of deflection of approximately 40 degrees, the invention can allow for angles of deflection from between approximately 10 degrees to approximately 80 degrees. A preferred range can be between approximately 20 degrees to approximately 60 degrees.

Although the invention shows the deflection as a straight or curved side, the deflector can have variable angles of deflection along its' surface. For example, the deflector can replicate a "ski jump" configuration, where the upper half of the deflector has a slight deflection (curved or straight surface), and the bottom angles at a greater deflection angle. Thus, the invention can cover increasing the ramp at the bottom.

The invention can be used with ammunition rounds of varying amounts, such as but not limited to 50, 75, 100, 125, 150, 175, 200 rounds or more, and any increment inbetween.

The invention can be incorporated by factories that manufacture the pouch bags and/or boxes. As shown above, the invention can include a sleeve, cover, cage, rods, combinations thereof, and the like, can be used on both the outside of a pouch bag/box and/or inside (as inserts) of the pouch bag/box to form both the deflection surface and to reshape of the bag/box to move the center of the gravity of the bag/box to a balanced position relative to the weapon.

As referenced above, the invention can be used with solid belt ammunition boxes having rigid sides, where a separate angled plate can be manufactured and/or formed and/or retrofitted on an inner or outer side of the box so that the center of gravity of the filled box is balanced relative to the machine gun. Also, the whole side of the box can be formed as the deflector. Additionally, the inner side of the ammunition box can be pre-molded into an angular plate configuration as described above forming both a dual purpose of having the center of gravity of the ammunition box moved under the center of gravity of the machine gun as well as form a deflector surface for deflecting the downwardly ejecting spent cartridges to a right side of the machine gun away from the operator/soldier.

Although a hardened box is shown, the boxes and the bags can have different shapes such as but not limited to a right triangular shape, trapezoid shape, hexagon shape, oblong shape, and any other workable shape, as long as an angled deflector portion is included to deflect the downwardly ejecting spent cartridges to one side of the weapon.

As discussed, the embodiment of the preceding figures can be used with both pouch bags and belt boxes. The size and shape of the bag and box determines that distance that the bag and box must be oriented in order to move the center of gravity of the filled bag/box to a balanced position relative to the gun and eliminate the tilting and problems of the prior art.

Although the preferred embodiments are for using the novel angled plate with ammunition pouch bags and ammunition boxes on machine guns, the invention would have applicability to other weapons where the ammunition holders is on the side, such as the right side of an automatic or semi-automatic weapon and ejects spent cartridges downward as well. Additionally, the invention can deflect downwardly ejected spent cartridges to the left side of the weapon as well away from both the weapon and the operator/soldier.

While the invention has been described, disclosed, illustrated and shown in various terms of certain embodiments or modifications which it has presumed in practice, the scope of the invention is not intended to be, nor should it be deemed to be, limited thereby and such other modifications or embodiments as may be suggested by the teachings herein are particularly reserved especially as they fall within the breadth and scope of the claims here appended.

I claim:

1. An ammunition holder for machine guns that downwardly eject spent cartridge cases, comprising:

an ammunition container for holding plural linked rounds of belted ammunition, wherein the container has an overall weight and mass with a center of gravity;

a mount mechanism for attaching the container to a side belt feeder on one side of the machine gun, the container having an outer side facing away from the machine gun and an inner side facing underneath the machine gun; and a rigid plate attached to the inner side of the ammunition container; and a hinge attached to the plate and a side portion of the firearm for moving the ammunition container to one side, so that the center of gravity of the mass and weight of the plural linked rounds of the belted ammunition held in the ammunition container is moved from the one side of the machine gun underneath the gun in the direction of an opposite side of the machine gun until the mass and weight of the container balances the machine gun, and wherein the plate deflects spent cartridges ejected downwardly from the machine gun to a side of the machine gun.

2. The ammunition holder of claim 1, wherein the ammunition container includes:

a pouch bag having a fabric surface.

3. The ammunition holder of claim 1, wherein the hinge includes:

a lock for locking the plate to a different angled position.

4. The ammunition holder of claim 3, wherein the hinge includes:

a switch for releasing the lock.

5. The ammunition holder of claim 4, wherein the switch includes a push button.

6. The ammunition holder of claim 1, wherein the plate is formed from a group selected from one of: steel, galvanized metal and aluminum.

7. The ammunition holder of claim 1, wherein the plate includes:

an angled plate.

8. The ammunition holder of claim 1, wherein the plate includes:

a planar-plate with a bent portion.

9. The ammunition holder of claim 1, wherein the plate includes:

a concave curved surface.

10. The ammunition holder of claim 1, further comprising:

a frame, wherein the plate and the hinge are attached to the frame, and the bag is inserted into the frame.

11. An improved automatic machine gun comprising:

a machine gun having a side belt ammunition loader on a left side, with a bottom ejector for downwardly ejecting spent cartridge cases beneath the machine gun;

an ammunition container for holding plural rounds of belt linked ammunition, with a mount mechanism for attaching the container to the side belt feeder on the left side of the machine gun, the container having an outer side facing away from the machine gun and an inner side facing underneath the machine gun, the container with the belt linked ammunition having a mass and a weight with a center of gravity;

a plate attached to the inner side of the ammunition container; and a hinge attached to the plate for bending the container so that the center of gravity of the mass and weight of the ammunition container is moved from the left side to a right side underneath the machine gun in order to balance the mass and the weight of the ammunition container relative to the machine gun and, and wherein the plate deflects spent cartridges ejected downwardly from the machine gun to one side of the machine gun away from both the machine gun and an operator.

12. The improved automatic machine gun of claim 11, wherein the ammunition container includes:

a pouch bag having a fabric surface.

13. The improved automatic machine gun of claim 11, wherein the plate includes:

a plate formed from at least one of a polymer and a plastic.

14. The improved automatic machine gun of claim 11, wherein the plate includes: a plate formed from metal.

15. An ammunition holder for firearms that downwardly eject spent cartridges, comprising:

an ammunition container for holding rounds of ammunition, wherein the container has an overall weight and mass with a center of gravity;

a mount mechanism for attaching the container to a side feeder on one side of the firearm, the container having an outer side facing away from the firearm and an inner side facing underneath the firearm; and a plate attached to the inner side of the ammunition container; and a pivoting member attached to the plate and a side portion of the ammunition container for moving the ammunition container to one side, so that the center of gravity of the mass and weight of the ammunition held in the ammunition container is moved from the one side of the firearm underneath the firearm in the direction of an opposite side of the firearm until the mass and weight of the container balances the firearm, and wherein the plate deflects spent cartridges ejected downwardly from the firearm to a side of the firearm.

16. The ammunition holder of claim 15, wherein the ammunition container includes:

a pouch bag having a fabric surface.

17. The ammunition holder of claim 15, wherein the pivoting member includes:

a hinge.

18. The ammunition holder of claim 15, wherein the pivoting member includes:

a lock for locking the plate to a different angled position.

19. The ammunition holder of claim 18, wherein the pivoting member includes:

a switch for releasing the lock.

20. The ammunition holder of claim 19, wherein the switch includes a push button.

21. The ammunition holder of claim 15, wherein the plate is formed from a group selected from one of: steel, galvanized metal and aluminum.

* * * * *